US008905798B2

(12) United States Patent
Amano et al.

(10) Patent No.: US 8,905,798 B2
(45) Date of Patent: Dec. 9, 2014

(54) TERMINAL FITTING AND METHOD OF PRODUCING IT

(71) Applicant: Sumitomo Wiring Systems, Ltd., Yokkaichi (JP)

(72) Inventors: Takamaru Amano, Yokkaichi (JP); Song Zheng, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 35 days.

(21) Appl. No.: 13/863,446

(22) Filed: Apr. 16, 2013

(65) Prior Publication Data

US 2013/0288545 A1 Oct. 31, 2013

(30) Foreign Application Priority Data

| | | |
|---|---|---|
| Apr. 26, 2012 | (JP) | 2012-101369 |
| May 16, 2012 | (JP) | 2012-112587 |
| May 17, 2012 | (JP) | 2012-113595 |
| May 30, 2012 | (JP) | 2012-123467 |

(51) Int. Cl.
*H01R 4/48* (2006.01)
*H01R 13/11* (2006.01)

(52) U.S. Cl.
CPC ..... *H01R 4/48* (2013.01); *H01R 13/113* (2013.01)
USPC ..... 439/817

(58) Field of Classification Search
USPC ..... 439/817, 845, 851, 852, 839
See application file for complete search history.

(56) References Cited

U.S. PATENT DOCUMENTS

| | | | | |
|---|---|---|---|---|
| 5,540,603 | A * | 7/1996 | Fujiwara | 439/851 |
| 5,839,925 | A * | 11/1998 | Simmons | 439/852 |
| 6,244,910 | B1 * | 6/2001 | Grubbs | 439/852 |
| 6,264,509 | B1 * | 7/2001 | Kwang et al. | 439/852 |
| 6,752,660 | B2 * | 6/2004 | Fujita et al. | 439/595 |
| 6,955,571 | B2 | 10/2005 | Fujii | |
| 7,144,281 | B2 * | 12/2006 | Maeda | 439/852 |
| 7,156,704 | B2 * | 1/2007 | Shimizu | 439/852 |
| 7,347,747 | B2 * | 3/2008 | Shimizu | 439/852 |
| 7,458,864 | B2 * | 12/2008 | Philipp | 439/851 |
| 8,241,075 | B2 * | 8/2012 | Ishikawa et al. | 439/851 |
| 8,454,394 | B2 * | 6/2013 | Iihoshi | 439/852 |

(Continued)

FOREIGN PATENT DOCUMENTS

| | | |
|---|---|---|
| JP | 2004-362832 | 12/2004 |
| JP | 2009-48831 | 3/2009 |
| JP | 2011-238372 | 11/2011 |

*Primary Examiner* — Alexander Gilman
(74) *Attorney, Agent, or Firm* — Gerald E. Hespos; Michael J. Porco; Matthew T. Hespos

(57) ABSTRACT

A terminal fitting has a tubular connecting portion (11) with includes a base wall (14) in the form of a flat plate. A first spring piece (25) is cantilevered in the connecting portion (11) and is resiliently deformed toward the base wall (14) when a mating tab comes into contact therewith. A second spring piece (31), which is narrower than the first spring piece (25), projects from the base wall (14) and comes into contact with the first spring piece (25) from the side of the base wall (14). Excessive deformation preventing pieces (36) project at opposite widthwise sides of the second spring piece on the base wall (14) and prevent excessive resilient deformation of the first spring piece (25) by coming into contact with a free end portion (27) of the first spring piece (25) from the side of the base wall (14).

13 Claims, 28 Drawing Sheets

(56) References Cited

U.S. PATENT DOCUMENTS 8,662,935 B2 * 3/2014 Jouas et al. ..... 439/660
2003/0224668 A1 * 12/2003 Matsuda ..... 439/839
2011/0294366 A1 * 12/2011 Iihoshi ..... 439/852
2012/0252283 A1 * 10/2012 Muro ..... 439/839
2013/0288548 A1 * 10/2013 Amano et al. ..... 439/852

* cited by examiner

TERMINAL FITTING AND METHOD OF PRODUCING IT

BACKGROUND

1. Field of the Invention

The invention relates to a terminal fitting and to a method of producing it.

2. Description of the Related Art

Japanese Unexamined Patent Publication No. 2011-238372 discloses a terminal fitting with a tubular connecting portion and a spring piece resiliently deformably arranged in the connecting portion. The connecting portion includes a base wall in the form of a flat plate extending in forward and backward directions and side walls standing up from opposite widthwise ends of the base wall. The spring piece is folded backward from the front end of the base wall and resiliently deformed toward the base wall when a tab of a mating terminal fitting inserted into the connecting portion comes into contact therewith. Further, cuts are made in the both side walls and cut portions are bent to project into the connecting portion, thereby forming excessive deformation preventing pieces. The spring piece is prevented from being excessively resiliently deformed by coming into contact with the excessive deformation preventing pieces.

Distances from the both side walls to the spring piece become longer, for example, if the width of the spring piece is smaller than that of the base wall. Thus, the projection amounts of the excessive deformation preventing pieces become larger and it becomes difficult to ensure a space for forming the excessive deformation preventing pieces on the both side walls by cutting and bending.

Further, in the above conventional configuration, the spring piece may be warped and deformed into a U shape so that a widthwise central portion drops toward the base wall with the opposite widthwise ends held in contact with the excessive deformation preventing pieces as supporting points.

In view of the above situation, it is also possible to form excessive deformation preventing pieces on the base wall. However, for example, when the spring piece is divided into a first spring piece and a second spring piece and the second sprint piece is provided on the base wall, there is a problem of being difficult to ensure a space for arranging the excessive deformation preventing pieces on the base wall.

Japanese Unexamined Patent Publication No. 2004-362832 discloses a terminal fitting with a tubular main portion and a resilient piece resiliently deformably arranged in the main portion. The resilient piece is in the form of a tongue piece extending backward in a cantilever manner from an arcuate supporting point portion connected to the front end of the main portion. A male tab of a mating terminal fitting is inserted into the main portion from front. The inserted male tab resiliently comes into contact with the resilient piece, whereby both terminal fittings are electrically connected.

If the resilient piece is narrow when the male tab is wide, the resilient piece cannot stably support the male tab and the male tab may be inclined such as by rolling about an axis.

On the other hand, if the resilient piece is made wider in conformity with the size of the male tab, a resilient reaction force applied to the male tab from the resilient piece becomes excessive and insertion operability of the male tab may be deteriorated. Contrary to this, if the resilient reaction force is reduced, such as by cutting the supporting point portion of the resilient piece, the male tab cannot be stably supported and may be inclined about the axis as in the above case.

Japanese Unexamined Patent Publication No. 2009-48831 discloses a terminal fitting with includes a rectangular tube which can come into contact with a tab portion of a male terminal fitting. The rectangular tube is composed of a bottom plate, a pair of side plates standing up from opposite side edges of the bottom plate, a ceiling plate bent at the upper end edge of one side plate and extending toward the other side plate and a pressing portion bent at the upper end edge of the other side plate and configured to prevent the opening of the ceiling plate by pressing the upper surface of the ceiling plate.

However, this configuration is not preferable in reducing the height of the terminal fitting since the pressing portion is placed on the ceiling plate and projects upward from the ceiling plate. As a countermeasure, it is thought to form a recessed area in the ceiling plate and place the pressing portion in this recessed area.

The following problem needs to be solved even if the above countermeasure is taken. Specifically, if the recessed area of the ceiling plate is formed by press working, a peripheral edge part in the recessed area generally becomes a moderately arcuate surface (R-surface). Thus, the pressing portion has to be arranged in a part of the recessed area inside the peripheral edge part while avoiding the peripheral edge part which is the R-surface. Then, a gap is formed between the peripheral edge of the recessed area and the end edge of the pressing portion.

On the other hand, in the process of inserting the terminal fitting into a cavity of a connector housing, a locking lance formed in the cavity slides in contact with the outer surface of the rectangular tube portion while being resiliently deformed. Thus, if the above gap is located on this slide contact path, the locking lance may drop into the gap and be caught by the end edge of the pressing portion, with the result that smooth insertion of the terminal fitting may be obstructed.

Japanese Unexamined Patent Publication No. 2004-206912 discloses a female terminal fitting with a rectangular tube composed of a bottom plate, a pair of side plates standing up from opposite side edges of the bottom plate and a pair of ceiling walls bent from the rising end edges of the both side plates. A leading end part of one of the both ceiling walls is bent downwardly to form a step, and a leading end part of the other ceiling wall is placed on this step part. A locking hole is formed in the step part. By fitting a locking piece formed by bending the leading end part of the other ceiling wall into this locking hole, the ceiling walls are prevented from being displaced in forward and backward directions.

However, the following problem needs to be solved in the case of adopting a displacement prevention structure as described above. Specifically, the locking piece projects outwardly from an end edge of the ceiling wall in the above female terminal fitting, which is not preferable in cutting layout.

The present invention was completed in view of the above situation and an object thereof is to improve overall operability and space efficiency.

SUMMARY OF THE INVENTION

The invention relates to a terminal fitting formed by bending an electrically conductive plate material to include a connecting portion with a base wall in the form of a substantially flat plate. The connecting portion is to be connected to a mating tab for connection with a mating terminal fitting; a first spring piece is cantilevered in or at the connecting portion and resiliently deformed toward the base wall when the tab comes into contact therewith. At least one second spring piece projects from the base wall toward the first spring piece and is resiliently deformed together with the first spring piece while coming into contact with the first spring piece from the side of the base wall. One or more excessive deformation preventing pieces project from the base wall at substantially opposite widthwise sides of the second spring piece to prevent excessive resilient deformation of the first spring piece by coming into contact with the first spring piece from the side of the base wall.

Operability and space efficiency are improved by arranging excessive deformation preventing pieces with high space efficiency while preventing a spring piece from being warped and deformed.

The connecting portion preferably has a tubular shape into which the mating tab is to be inserted for connection. The second spring piece preferably is narrower than the first spring piece and projects into the connecting portion from the base wall.

The excessive deformation preventing pieces project into the connecting portion from the base wall. Thus, the first spring piece about to be excessively resiliently deformed toward the base wall stably comes into contact with the excessive deformation preventing pieces at the base wall side to prevent warping and deformation. Although the second spring piece projects from the base wall, a space for arranging the excessive deformation preventing piece(s) is ensured because the second spring piece is narrower than the first spring piece and because the excessive deformation preventing pieces are adjacent to the second spring piece.

The present invention can be further embodied as follows.

A punched hole preferably penetrates through the base wall and the second spring piece and the excessive deformation preventing pieces are formed by bending parts of the base wall defining the punched hole. Space efficiency is improved since the second spring piece and the excessive deformation preventing pieces are formed via the common punched hole.

A free end portion of the first spring piece preferably is narrower than a base end portion which serves as a supporting point of resilient deformation. According to such a configuration, stress generated when the tab comes into contact with the first spring piece is distributed well. Further, since the excessive deformation preventing pieces project from the base wall, the excessive deformation preventing pieces can contact the first spring piece even if the free end portion of the first spring piece is narrow.

The invention also relates to a terminal fitting with a tubular main portion for receiving a male tab of a mating terminal fitting. A first resilient piece in the form of a tongue is arranged in or at the main portion and is cantilevered back from a support at the front end of the main portion. The male tab inserted in the main portion resiliently contacts a rear end portion of the first resilient piece, thereby electrically conductively connecting the terminal fitting to the mating terminal fitting. The first resilient piece has a constant width from the support to the rear end portion. A through hole penetrates through the support and is shaped to become gradually wider toward the back of the first resilient piece while leaving opposite widthwise ends and the rear end portion of the first resilient piece.

Accordingly, overall operability is improved by providing a terminal fitting capable of stably supporting a male tab while maintaining good insertion operability of the male tab.

Since the first resilient piece particularly substantially has the constant width from the supporting point portion to the rear end portion, a large width of the rear end portion to be held in contact with the male tab can be ensured. Thus, the male tab is more stably supported by the resilient piece. Further, the through hole is formed in the (first) resilient piece while leaving the substantially opposite widthwise end portions and the rear end portion of the resilient piece, penetrates through the supporting point portion and is shaped to become gradually wider toward the back. Thus, the magnitude of a resilient reaction force of the supporting point portion is adjusted to a proper one. As a result, insertion operability of the male tab is improved.

A second resilient piece may be arranged at a position substantially facing the (first) resilient piece in a resilient deforming direction of the (first) resilient piece in the main portion. The second resilient piece particularly is arranged to be able to come into contact substantially with a widthwise central portion of the rear end portion of the (first) resilient piece and is resiliently deformed by being pressed by the (first) resilient piece when the male tab at least partly is inserted into the main portion. Since the second resilient piece can come into contact with the widthwise central portion of the rear end portion of the (first) second resilient piece, the male tab is more stably supported by the rear end portion of the resilient piece.

Excessive deformation preventing pieces may be arranged adjacent to the second resilient piece, particularly at substantially opposite widthwise sides of the second resilient piece in the main portion. The one or more, particularly pair of excessive deformation preventing pieces are arranged to be able to come into contact with the (first) resilient piece, particularly with the substantially opposite widthwise end portions of the rear end portion of the (first) resilient piece and/or prevent excessive resilient deformation of the (first) resilient piece by coming into contact with the (first) resilient piece. Since the second resilient piece is arranged to be able to come into contact substantially with the widthwise central portion of the rear end portion of the (first) resilient piece and the one or more, particularly the pair of excessive deformation preventing pieces are arranged to be able to come into contact the (first) resilient piece, particularly with the substantially opposite widthwise sides of the rear end portion of the resilient piece, the second resilient piece and the one or more, particularly pair of excessive deformation preventing pieces are arranged with high space efficiency while the stable support of the male tab is ensured.

The invention further relates to a terminal fitting with a tube for receiving a mating terminal fitting. A locking lance formed in a cavity of a connector housing being restored to be engaged with the tube after sliding in contact with the outer surface of the tube while being resiliently deformed when the terminal fitting is at least partly accommodated into the cavity. The tube includes a base plate, a pair of side plates projecting from the base plate and a ceiling plate extending from the rising end edge of one of the side plates substantially in parallel to the base plate. The outer surface of the ceiling plate is struck into the tube, thereby forming a struck area to form a contact portion for the mating terminal fitting. A pressing portion extends from the rising end edge of the other side plate and is bent to extend from the rising end edge of the other side plate substantially in parallel to the bottom plate. The pressing portion is placed on the outer surface of the ceiling plate in the struck area to prevent the opening of the ceiling plate. At least one bridge is arranged on the slide contact path and in at least one gap between the end edge of the pressing portion and the peripheral edge of the struck area. The bridge is formed to make the outer surface of the ceiling plate and that of the pressing portion substantially continuous along a slide contact path along which the locking lance slides in contact with the outer surface of the tube. Accordingly, overall operability is improved by providing a terminal fitting smoothly at least partly insertable into a cavity.

The extending end edge of the ceiling plate may be supported in contact with at least one receiving portion formed on the other side plate.

According to the above, in forming the rectangular tube, the pressing portion enters an inner part of the struck area to come into contact with the outer surface of the struck area, thereby preventing the opening of the ceiling plate. At this time, the gap is formed between the pressing portion and the peripheral edge of the struck area. On the other hand, in the process of inserting the terminal fitting into the cavity of the connector housing, the locking lance slides in contact with the outer surface of the rectangular tube portion while being resiliently deformed. Since the bridge portion is formed on the slide contact path of the locking lance to fill up the gap between the peripheral edge of the struck area and the end edge of the pressing portion during this time, the locking lance can move between the ceiling plate and the pressing portion without being caught by the bridging of the bridge portion. Therefore, the terminal fitting can be smoothly inserted.

The depth of the struck area preferably is set to be substantially equal to the thickness of walls forming the tube, and the outer surface of the bridge is substantially flat and/or the height of the outer surface of the bridge is set to be substantially equal to those of the outer surface of the ceiling plate and the outer surface of the pressing portion. According to this configuration, the terminal fitting can be more smoothly inserted since the locking lance is not substantially vertically displaced while passing on the outer surface of the rectangular tube portion. Further, the outer surface of the pressing portion is aligned at the same height as the outer surface of the ceiling plate and does not project out, which contributes to a reduction in the height of the entire terminal fitting.

At least one R-surface which is formed on a peripheral edge part and a flat surface which is formed at the inner side of the R-surface and with which the pressing portion comes into contact may be formed in the struck area; and the bridge may be formed by striking a part of the R-surface corresponding to the slide contact path in a direction outward of the (particularly rectangular or polygonal) tube. According to this configuration, the bridge can be easily formed by striking the part of the R-surface outward.

One or more, particularly a pair of bridges may be arranged at such positions as to hold the pressing portion therebetween in an extending direction of the slide contact path. According to this configuration, it can be reliably avoided that the locking lance sliding in contact is caught since a pair of gaps located on the slide contact path of the locking lance can be respectively filled up by the bridges. Further, an effect of restricting a displacement of the pressing portion in a sliding direction of the locking lance by the both bridge portions can also be obtained.

The invention also relates to a terminal fitting, comprising a tube for receiving a mating terminal fitting. The tube includes a base plate, a first side plate and a second side plate projecting from the base plate and a ceiling plate bent to extend from the rising end edge of the first side plate substantially in parallel to the base plate. At least one pressing portion is formed on the rising end edge of the second side plate and is bent to be placed on the outer surface of the ceiling plate. An engaging portion is formed on either one of the ceiling plate and the second side plate, and a displacement preventing portion engageable with the engaging portion is formed on the other one of the ceiling plate and the second side plate. The displacement preventing portion is arranged at a position spaced inward in a width direction from the extending end edge of the ceiling plate or the extending end edge of the pressing portion on the ceiling plate or the second side plate. Accordingly, overall operability is improved by providing a terminal fitting capable of improving yield.

The displacement preventing portion formed on either the ceiling plate or the second side plate is engaged with the front and/or rear parts of the engaging portion formed on the mating side to prevent displacements of the ceiling plate in forward and backward directions. Further, the displacement preventing portion does not project in the width direction from the extending end edge of the ceiling plate or that of the second side plate and is formed at the position spaced inwardly from the extending end edge and provided within the width range of the ceiling plate or the second side plate. This is advantageous in cutting layout.

In the terminal fitting of the present invention, it is preferable that an extending end part of the ceiling plate is struck inwardly of the tube to form a struck or bent portion and the pressing portion is placed on the outer surface of the struck or bent portion to be substantially flush with the ceiling plate.

The engaging portion preferably is an opening formed in the struck portion; and the displacement preventing portion is formed on the second side plate and inserted into the opening to be engageable with front and/or rear sides of the opening edge. According to such a configuration, the height of the terminal fitting can be reduced since the pressing portion is placed to be substantially flush with the ceiling plate. Further, since the engaging portion is the opening in the struck portion located below the pressing portion and the displacement preventing portion is engaged with the front and/or rear sides of the opening edge of this opening, engaged parts of the displacement preventing portion and the engaging portion do not project out from the outer surface of the pressing portion. This also contributes to a reduction in the height of the terminal fitting.

The displacement preventing portion may be formed by bending an inner area of a substantially U-shaped cut formed at a position spaced inwardly from the extending end edge of the pressing portion such that the inner area having a width substantially equal to the width of the opening in forward and backward directions at least partly is inserted into the opening. According to such a configuration, the displacement preventing portion is formed by bending the inner area of the cut formed in the pressing portion and inserting it into the opening of the struck portion. By engaging the thus formed displacement preventing portion with the front and rear sides of the opening edge of the opening, displacements of the ceiling plate in forward and backward directions can be prevented.

The displacement preventing portion may be formed by causing a part spaced inwardly from the extending end edge of the pressing portion to project in a rib-like manner in a height direction so as to be inserted into the opening while having a width substantially equal to the width of the opening in forward and backward directions. According to such a configuration, the displacement preventing portion is formed by causing the part of the displacement preventing portion to project in a rib-like manner and inserting this part into the opening. By engaging the thus formed displacement preventing portion with the front and rear sides of the opening edge of the opening, displacements of the ceiling plate in forward and backward directions can be prevented.

The displacement preventing portion may be formed by causing a part of the second side plate near the rising end edge to project in a rib-like manner in the width direction within a standing height range of the second side plate from the base or bottom plate so as to be inserted into the opening while having a width substantially equal to the width of the opening in forward and backward directions. According to such a configuration, the displacement preventing portion is formed by causing the part of the second side plate to project in the width direction and inserting this part into the opening. By engaging the thus formed displacement preventing portion with the front and/or rear sides of the opening edge of the opening, displacements of the ceiling plate in forward and backward directions can be prevented.

The terminal fitting may be processed in a developed state and a plurality of terminal fittings may be coupled to a carrier in a chain-like manner in the developed state; and the extending end edge of the pressing portion and that of the ceiling plate particularly may face each other in a linkage direction between the terminal fittings adjacent to each other in the linkage direction in the coupled state. According to such a configuration, the extending end edge of the pressing portion and that of the ceiling plate face each other between the terminal fittings adjacent to each other in the developed state. In such a case, the displacement preventing portion does not project from the extending end edge of the second side plate or the ceiling plate, but is formed at the position spaced inwardly from the extending end edge. Thus, the extending end edge of the pressing portion and that of the ceiling plate can be proximate to each other. This is advantageous in cutting layout of the terminal fittings and can achieve a yield improvement.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
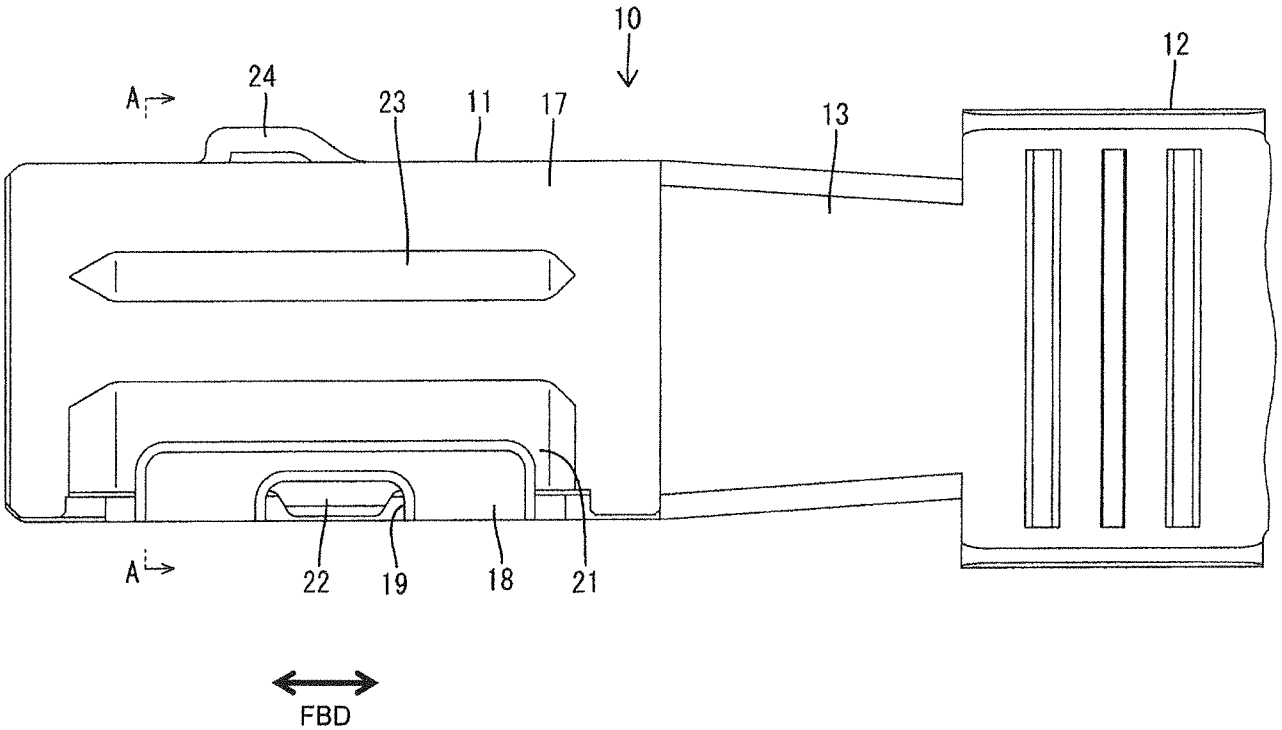
FIG. 1 is a plan view of a connecting portion of a terminal fitting according to a first embodiment of the present invention.

A first embodiment of the invention is described with reference to FIGS. 1 to 5. A terminal fitting 10 according to the first embodiment is formed unitarily, such as by bending, folding and/or embossing an electrically conductive metal plate to define a connecting portion 11 and a wire connection barrel 12, as shown in FIG. 1. The barrel 12 initially is open, but can be crimped, folded or deformed into connection with an end portion of an unillustrated wire. An end of the terminal fitting 10 that is to be connected to a mating terminal fitting is referred to herein as the front.

Figure 2:
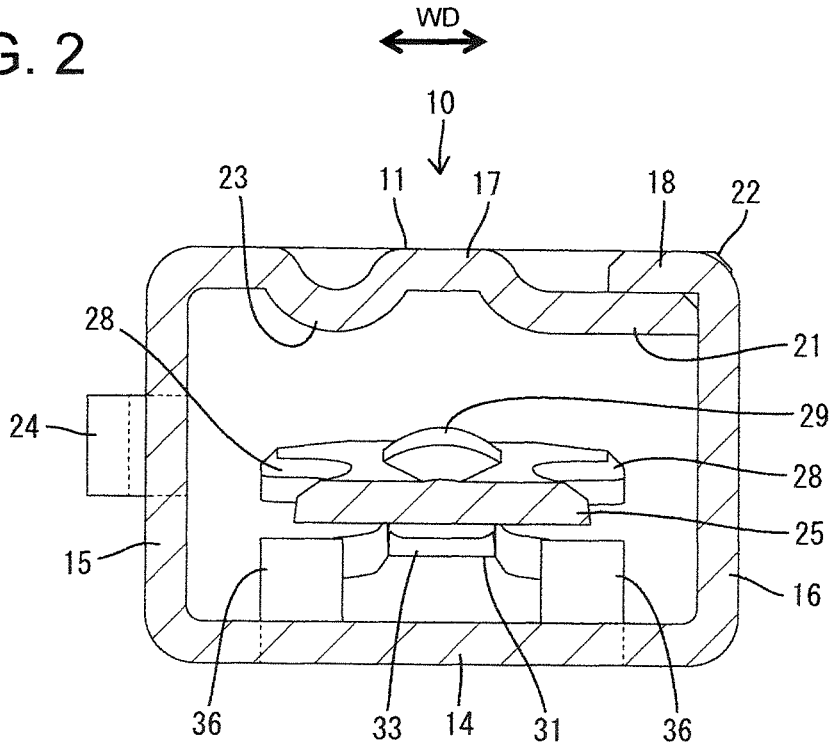
FIG. 2 is a section along A-A of FIG. 1.

The connecting portion 11 is located before the wire barrel 12 with a coupling portion 13 located between the connecting portion 11 and the wire barrel 12. As shown in FIG. 2, the connecting portion 11 is a substantially rectangular tube and a tab of an unillustrated terminal fitting is to be inserted into the connecting portion 11 from the front for connection. Specifically, the connecting portion 11 includes a substantially flat base wall 14 connected to the coupling portion 13 and extending in forward and backward directions FBD. First and second side walls 15, 16 project up from opposite widthwise sides of the base wall 14 and a ceiling wall 17 extends from the upper end of the first side wall 15 to the upper end of the second side wall 16.

A bent piece 18 is formed at the upper end of the second side wall 16 and is bent toward an upper end of the first side wall 15. As shown in FIG. 1, a through hole 19 is formed at the base end of the bent piece 18. Further, as shown in FIG. 2, a free end portion of the ceiling wall 17 is struck, hammered, embossed, stamped or otherwise deformed inward into the connecting portion 11 to form a first receiving portion 21 that contacts the lower or inner surface of the bent piece 18. The first receiving portion 21 has a projection 22 that is inserted into the through hole 19, as shown in FIG. 1, to maintain a substantially tubular shape of the connecting portion 11.

The ceiling wall 17 is struck, hammered, embossed, stamped or otherwise deformed at a position substantially parallel to the first receiving portion 21 in a width direction WD to project inward to form a second receiving portion 23. The first and second receiving portions 21, 23 are long narrow ribs that extend in forward and backward directions FBD for contacting the tab inserted into the connecting portion 11.

A stabilizer 24 projects out from the first side wall 15, as shown in FIG. 2. The terminal fitting 10 is to be inserted into a cavity of an unillustrated connector housing. The stabilizer 24 enters a guide groove of the cavity to guide the insertion of the terminal fitting 10 and to prevent insertion if the terminal fitting 10 is in an improper posture (e.g. an upside-down).

Figure 3:
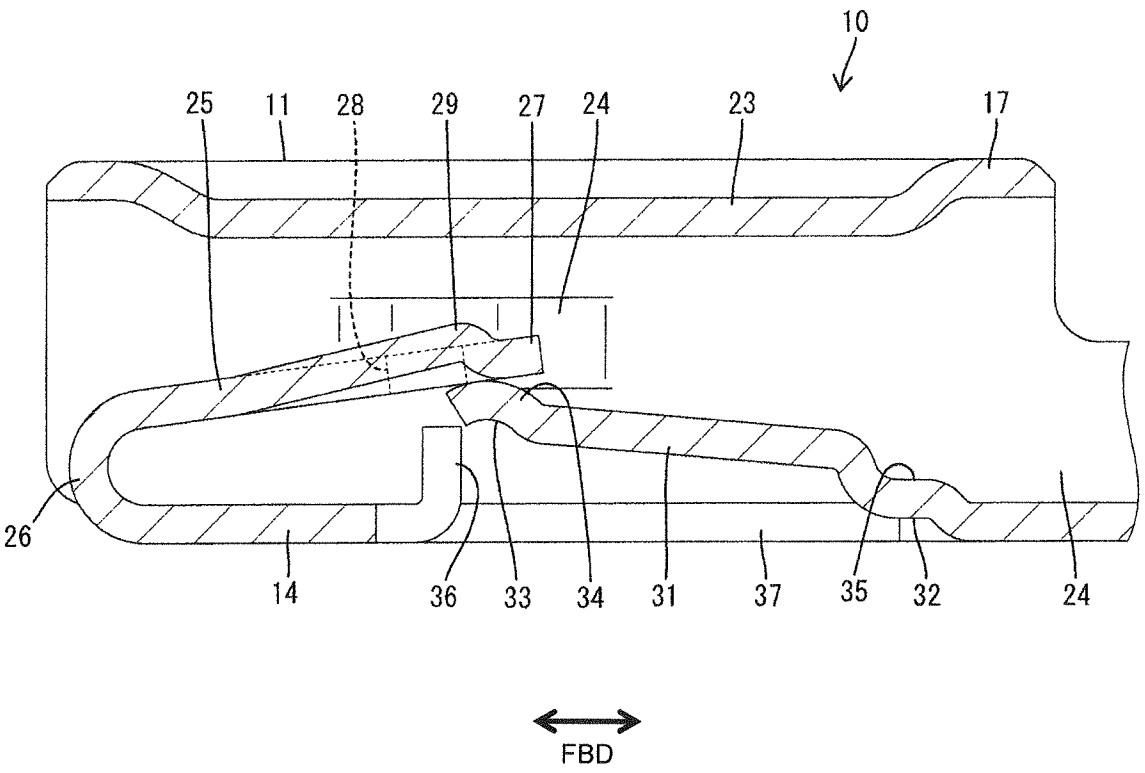
FIG. 3 is a side view in section of the connecting portion.

A first resiliently deformable spring piece 25 is arranged in the connecting portion 11. As shown in FIG. 3, the first spring piece 25 is formed by folding back a part that projects forward from the front end of the base wall 14 and is cantilevered obliquely up and back from a base end 26 connected to the base wall 14 to a free end 27.

Figure 4:
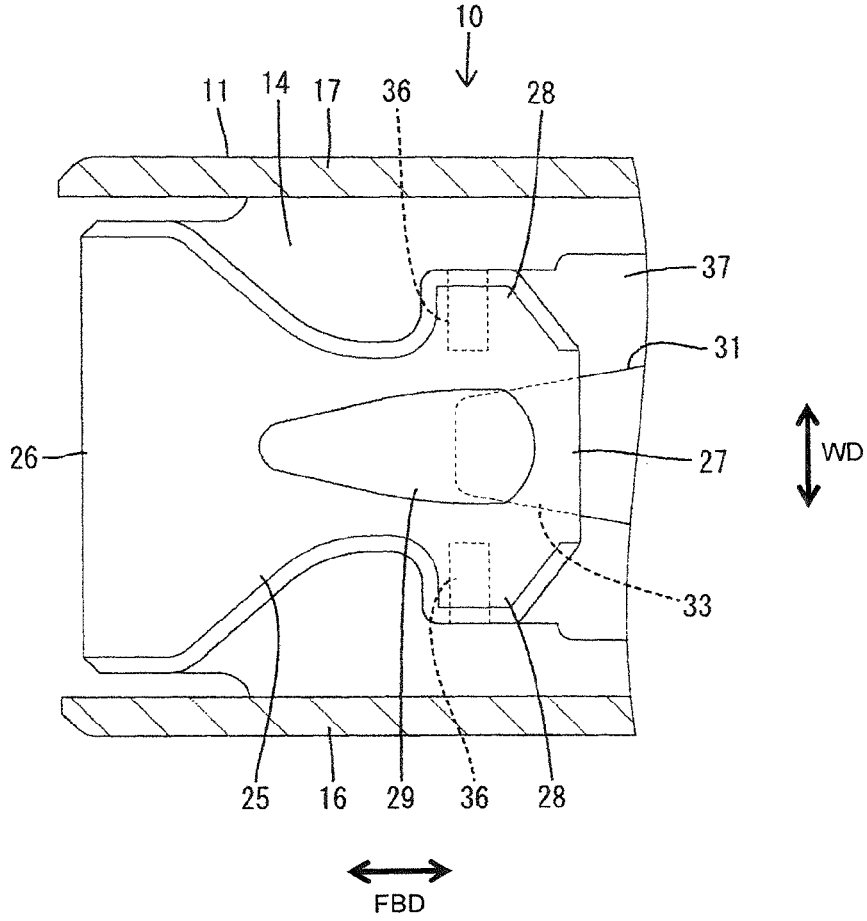
FIG. 4 is a top view in section of the connecting portion.

As shown in FIG. 4, the first spring piece 27 comprises a longitudinal portion that is narrower that a portion of the first spring piece 27 connected to the base wall 14. Specifically, the free end portion 27 of the first spring piece 25 is narrower than the base end 26. Further, two bulges 28 are formed near the free end 27 of the first spring 25 and project out in the width direction WD. Thus, the opposite lateral edges of the first spring piece 25 are constricted from the base end 26 to the bulges 28.

As shown in FIG. 2, the free end 27 of the first spring piece 25 is struck, hammered, embossed, stamped or otherwise deformed up into the connecting portion 11 and away from the base wall 14 to form a contact 29. The tab inserted into the connecting portion 11 is sandwiched resiliently between the contact 29 and the first and second receiving portions 21, 23 for electrically connecting the terminal fitting 10 to the mating terminal fitting. The contact 29 extends from a substantially central part of the free end 27 in the width direction WD to a constricted area and is arranged at substantially the same height as the stabilizer 24.

A second resiliently deformably spring piece 31 is arranged in the connecting portion 11. As shown in FIG. 3, the second spring piece 31 is cantilevered obliquely up and in away from the base wall 14 to the front from a rear end portion of the base wall 14 in the connecting portion 11. Specifically, the second spring piece 31 is in a substantially central part of the base wall 14 in the width direction WD and is narrower than the first spring 25, as shown in FIG. 2. Further, as shown in FIG. 5, the second spring piece 31 is narrowed gradually from a base end 32 connected to the base wall 14 to a free end 33.

As shown in FIG. 4, the free end 33 of the second spring piece 31 overlaps the free end 27 of the first spring piece 25 in forward and backward directions FBD. Specifically, as shown in FIG. 3, the free end 33 of the second spring piece 31 is located below the first spring piece 25 in a deformation space for the first spring piece 25 and is held constantly in contact with the free end portion 27 of the first spring piece 25. More specifically, the free end 33 of the second spring piece 31 is located substantially in a substantially central part of the base wall 14 in the width direction WD and is held in contact with a substantially central part of the free end 27 of the second spring piece 31 in the width direction WD, as shown in FIG. 4. As shown in FIG. 3, the free end 33 of the second spring piece 31 is shaped to form a touching portion 34 that projects toward and to be held in contact with the first spring piece 25. The base end 32 of the second spring piece 31 is bent or shaped to form a step 35.

Excessive deformation preventing pieces 36 are arranged fixedly in the connecting portion 11. The excessive deformation preventing pieces 36 project up at positions near a front end of the base wall 14. Specifically, as shown in FIG. 2, the excessive deformation preventing pieces 36 are substantially rectangular plates with plate surfaces aligned at an angle, preferably a substantially right angle to a plate surface of the base wall 14 and extend in the width direction WD. The two excessive deformation preventing pieces 36 are arranged on the base wall 14 at substantially opposite widthwise sides of the free end 33 of the second spring piece 31. Specifically, the excessive deformation preventing pieces 36 are at opposite sides of the widthwise center of the base wall 14 and at positions near the widthwise center of the base wall 14. Further, the excessive deformation preventing pieces 36 are arranged below or outside the bulges 28 of the first spring piece 25 and limit resilient deformation of the first spring piece 25 by contacting the lower surfaces of the bulges 28 when the first spring piece 25 is about to be deformed excessively.

Figure 5:
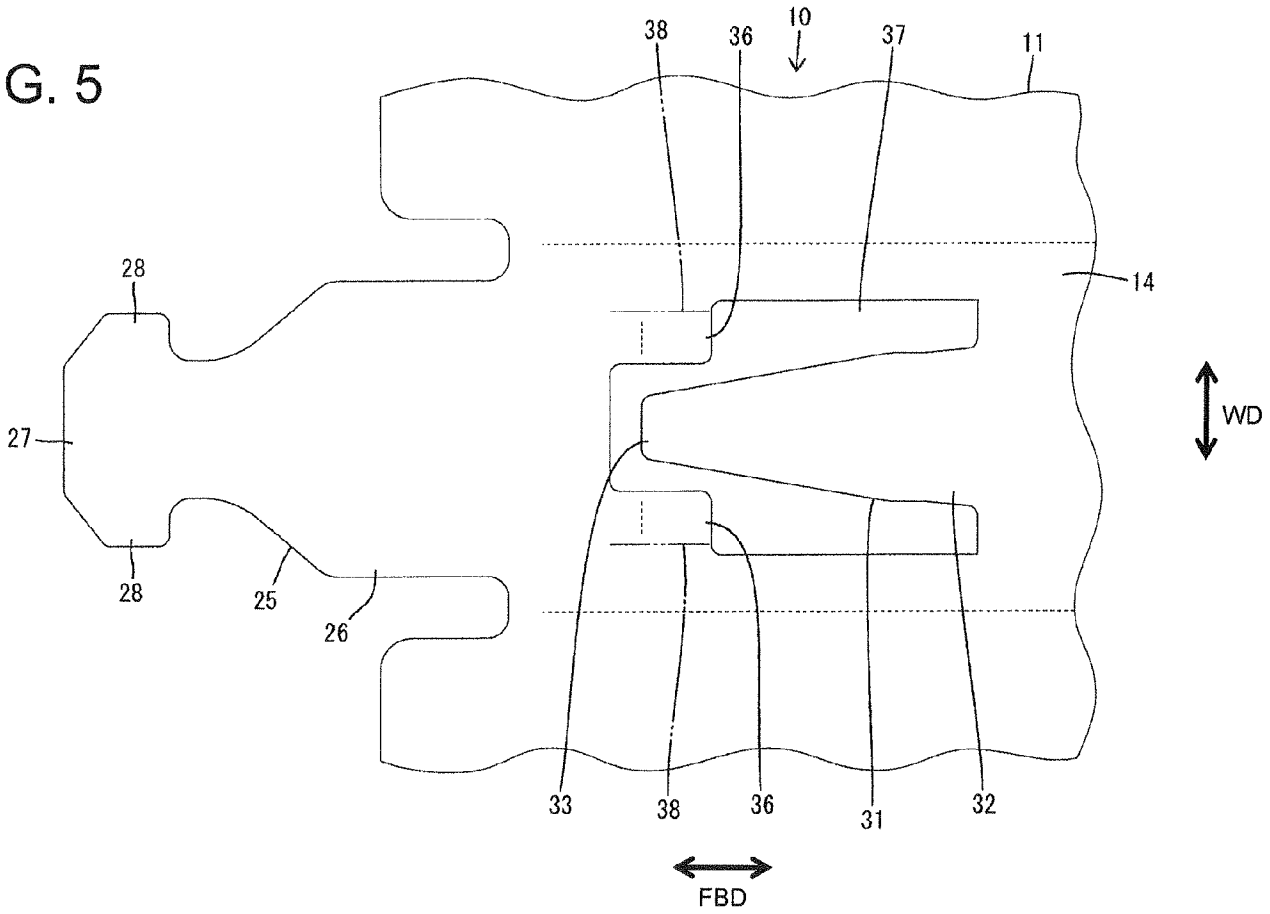
FIG. 5 is a development of the connecting portion.
Figure 6:
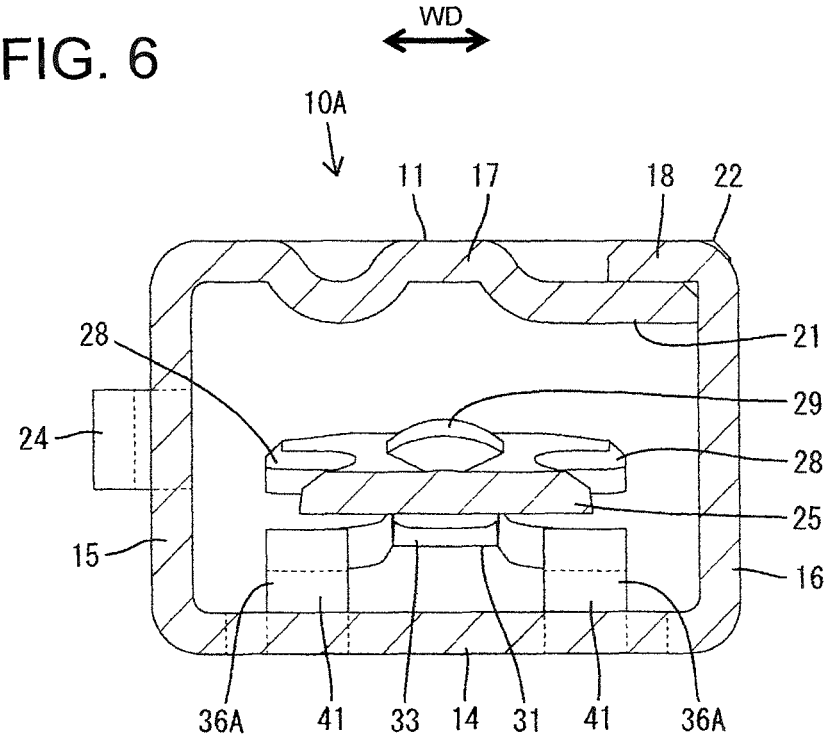
FIG. 6 is a front view in section of a connecting portion of a terminal fitting according to a second embodiment of the present invention when viewed from front.

As shown in FIG. 5, a punched hole 37 penetrates through a substantially central part of the base wall 14 in the width direction WD and enables the second spring piece 31 and the excessive deformation preventing pieces 36 to be bent. The second spring piece 31 projects forward from the rear side of the punched hole 37 before being bent into the connecting portion 11. Further, before being bent into the connecting portion 11, the excessive deformation preventing pieces 36 bulge out toward the free end of the second spring piece 31 at opposite front corners) of the punched hole 37 in the width direction WD. Thus, the rear edge of the punched hole 37 is defined by the second spring piece 31 and the opposite widthwise sides of the front edge of the punched hole 37 are defined by the excessive deformation preventing pieces 36.

The terminal fitting 10 is formed by bending the second spring piece 31 to be raised from the punched hole 37 and the excessive deformation preventing pieces 36 are bent to be raised from the punched hole 37 while being cut along cutting lines 38 of the base wall 14 shown in FIG. 5. The free end 33 of the second spring piece 31 contacts the free end portion 27 of the first spring piece 25 from below and the excessive deformation preventing pieces 36 are arranged to face and contact the corresponding portion bulging pieces 28 of the first spring piece 25 from below, as shown in FIGS. 2 and 3.

The terminal fitting 10 then is inserted into the cavity of the unillustrated connector housing and the tab is inserted into the connecting portion 11 from the front as the connector housing is connected. The tab contacts the contact 29 of the first spring piece 25 and is sandwiched resiliently between the contact 29 and the first and second receiving portions 21, 23. At this time, the first spring piece 25 is deformed resiliently out toward the base wall 14 and the second spring piece 31 is pressed by the first spring piece 25 and also is deformed resiliently toward the base wall 14. Resilient forces of the first and second spring pieces 25, 31 apply appropriate contact pressure to the tab.

On the other hand, the bulges 28 of the first spring piece 25 can contact the corresponding excessive deformation preventing pieces 36 to prevent excessive deformation of the first spring piece 25. In this case, the free end 27 of the first spring piece 25 is narrow and the excessive deformation preventing pieces 36 prevent the excessive deformation of the first spring piece 25 at the positions near the widthwise center of the base wall 14. Thus, the first spring piece 25 will not warp into a U shape.

The excessive deformation preventing pieces 36 of the first embodiment project from the base wall 14. Thus, the surface of the first spring piece 25 that faces the base wall 14 stably contacts the excessive deformation preventing pieces 36 before the first spring piece 25 is deformed excessively and the contact is at locations on the first spring piece 25 to prevent warping deformation. The second spring piece 31 is narrower than the first spring piece 25. Thus, a space for the excessive deformation preventing pieces 36 is ensured by arranging the excessive deformation preventing pieces 36 adjacent opposite widthwise sides of the second spring piece 31

The punched hole 37 penetrates the base wall 14 and both the second spring piece 31 and the excessive deformation preventing pieces 36 are formed by bending parts of the base wall 14 defining the punched hole 37. Thus, it is not necessary to form separate punched holes for the second spring piece 31 and for the excessive deformation preventing pieces 36. Therefore, space efficiency is improved and the terminal fitting 10 can be miniaturized.

The free end 27 of the first spring piece 25 is narrower than the base end 26. Thus, stress generated when the tab contacts the first spring piece 25 can be distributed substantially equally in the entire first spring piece 25. Further, the excessive deformation preventing pieces 36 project from the base wall 14 and can contact the first spring piece 25 even if the free end 27 of the first spring piece 25 is narrow.

FIGS. 6 to 9 show a terminal fitting 10A according to a second embodiment of the invention. Excessive deformation preventing pieces 36A and a punched hole 37A of the second embodiment differ from those of the first embodiment. Other elements are substantially the same or similar to the first embodiment. Those elements that are substantially the same or similar to the first embodiment are denoted by the same reference signs, but are not described again.

Figure 7:
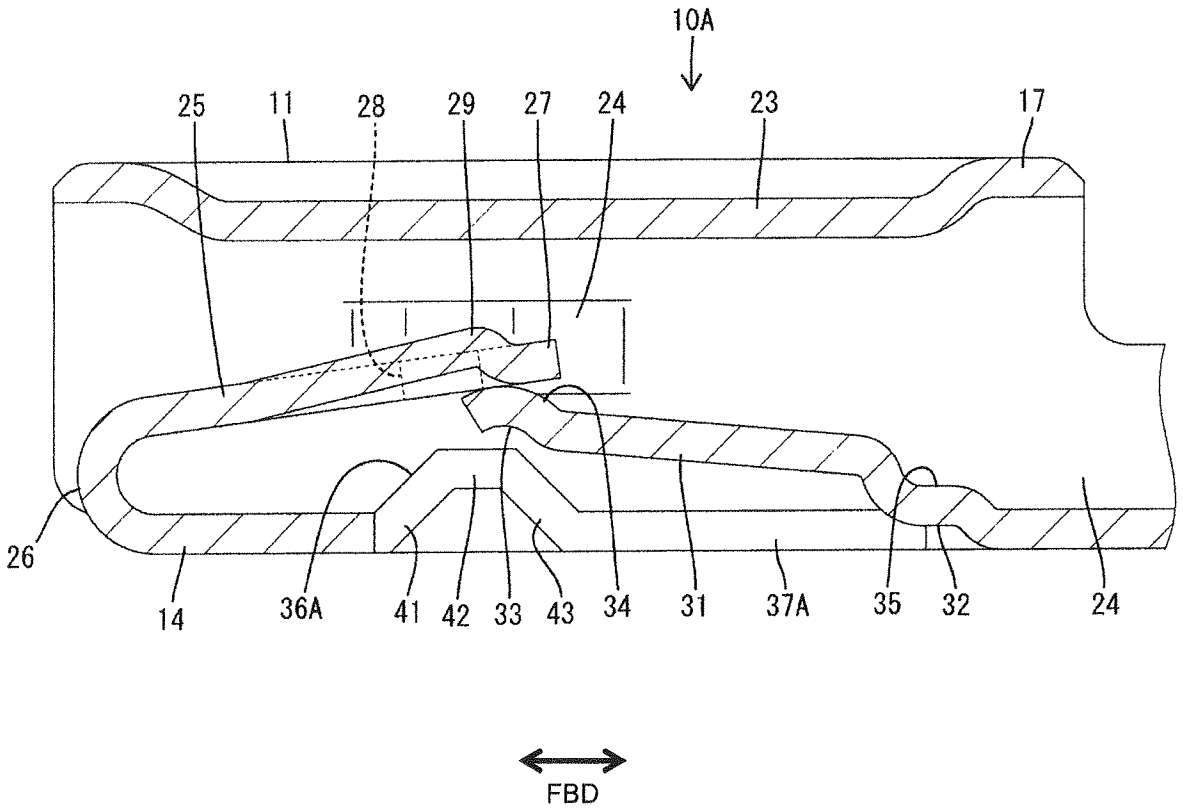
FIG. 7 is a side view in section of the connecting portion.
Figure 8:
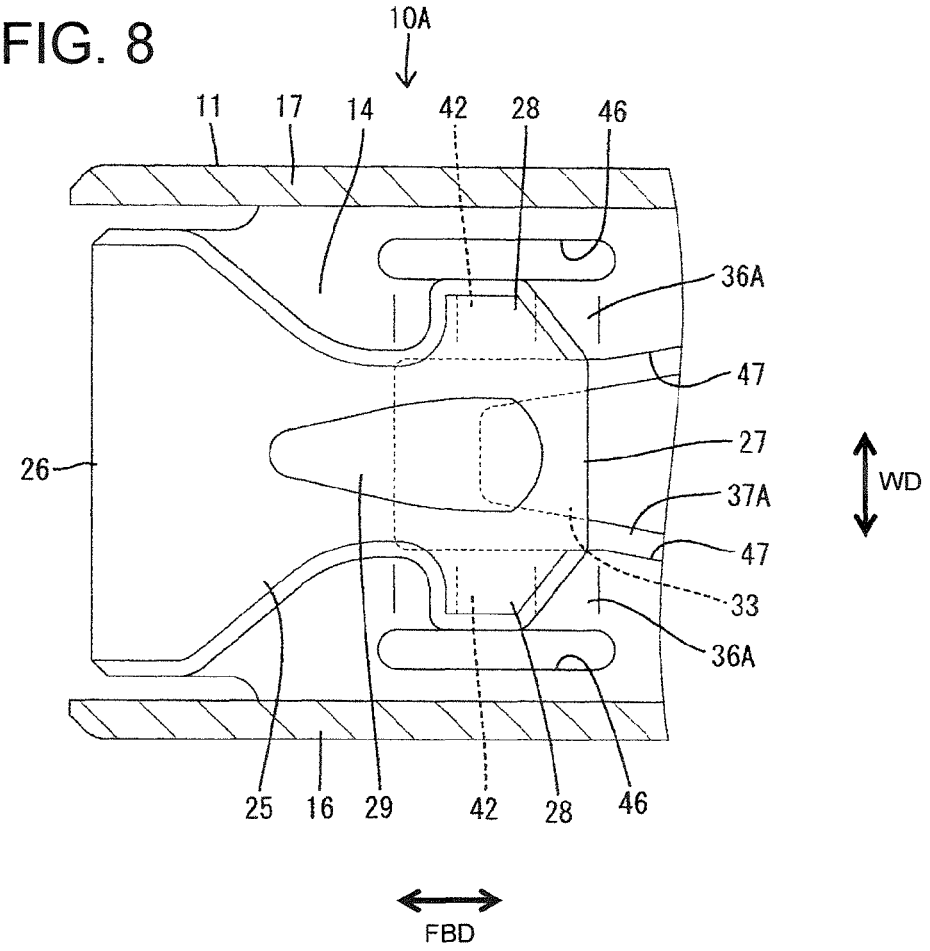
FIG. 8 is a top view in section of the connecting portion.

As shown in FIG. 7, the excessive deformation preventing piece 36A is formed by striking, hammering, embossing, stamping or otherwise deforming a base wall 14 into a connecting portion 11. Specifically, the excessive deformation preventing piece 36A has a substantially trapezoidal shape and includes a first piece 41 extending obliquely up and in to the back from the front end connected to the base wall 14, a second piece 42 extending back from the rear end of the first piece 41 and a third piece 43 extending obliquely down and out to the back from the rear end of the second piece 42. Similarly to the first embodiment, two excessive deformation preventing pieces 36A are arranged at substantially opposite widthwise sides of the free end 33 of the second spring piece 31 and outside of or below the bulges 28 of a first spring piece 25. As shown in FIG. 8, the second pieces 42 of the excessive deformation preventing pieces 36A overlap the bulges 28 in forward and backward directions FBD and excessive deformation preventing pieces 36A is longer in forward and backward directions FBD than the bulges 28 in forward and backward directions FBD. Thus, the second pieces 42 of the excessive deformation preventing pieces 36A contact the corresponding bulges 28 of the first spring 25 to prevent excessive deformation of the first spring piece 25.

Figure 9:
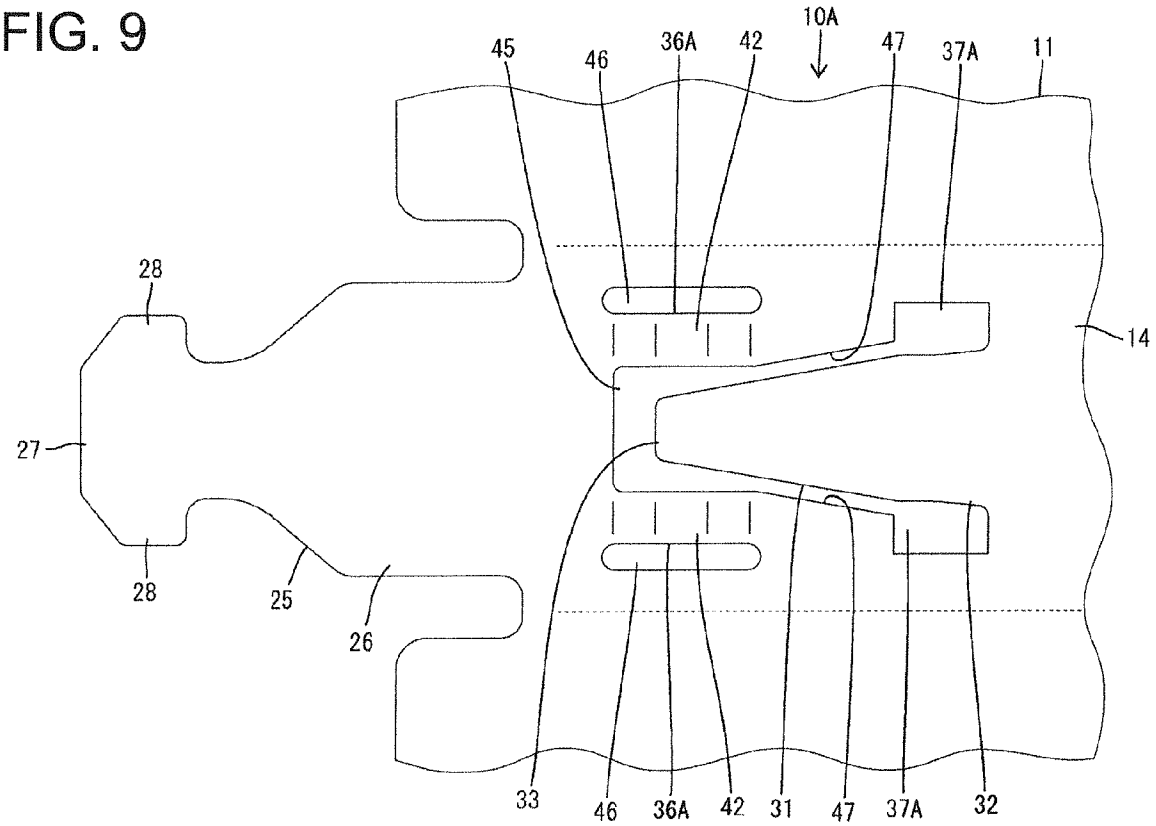
FIG. 9 is a development of the connecting portion.

As shown in FIG. 9, the base wall 14 has a common punched hole 37A that enables both excessive deformation preventing pieces 36A and the second spring piece 31 to be formed, as in the first embodiment. In this case, the punched hole 37A is composed of a main hole 45 defined by the entire outer edge of the second spring piece 31 and the inner edges of both excessive deformation preventing pieces 36A and two laterally spaced slit-like auxiliary holes 46 defined by the outer edges of the excessive deformation preventing pieces 36A. Specifically, the main hole 45 and the auxiliary hole 46 are arranged substantially parallel to each other at opposite widthwise sides of the excessive deformation preventing piece 36A. Further, oblique portions 47 are formed on rear portions of the excessive deformation preventing pieces 36A and extend oblique to forward and backward directions FBD along the opposite lateral edges of a tapered part of the second spring piece 31. The excessive deformation preventing pieces 36A are struck, hammered, stamped, embossed or otherwise shaped in a state shown in FIG. 9 to be bent into the connecting portion 11 while having a substantially trapezoidal shape.

The second embodiment achieves larger contact areas of the first spring piece 25 and the excessive deformation preventing pieces 36A because the length of the second piece 42 of each excessive deformation preventing pieces 36 in forward and backward directions FBD is longer than in the first embodiment.

The invention is not limited to the above described embodiments. For example, the following embodiments also are included in the scope of the invention.

The second spring piece and the excessive deformation preventing pieces may be formed via separate punched holes.

The bulges may not be formed on the first spring piece.

The excessive deformation preventing pieces may be arranged to contact the base end of the first spring piece.

The first spring piece may have substantially the same width over the entire length may have a free end wider than the base end.

The second spring piece may have substantially the same width over the entire length or may have the free end wider than the base end.

The excessive deformation preventing pieces may be shaped differently from each other.

A third embodiment of the invention is described with reference to FIGS. 10 to 13. A terminal fitting 110 of this embodiment is formed by bending, folding and/or embossing an electrically conductive metal plate and includes a main portion 120, a wire barrel 160 to be connected to a wire 190 and a first resilient piece 140.

Figure 10:
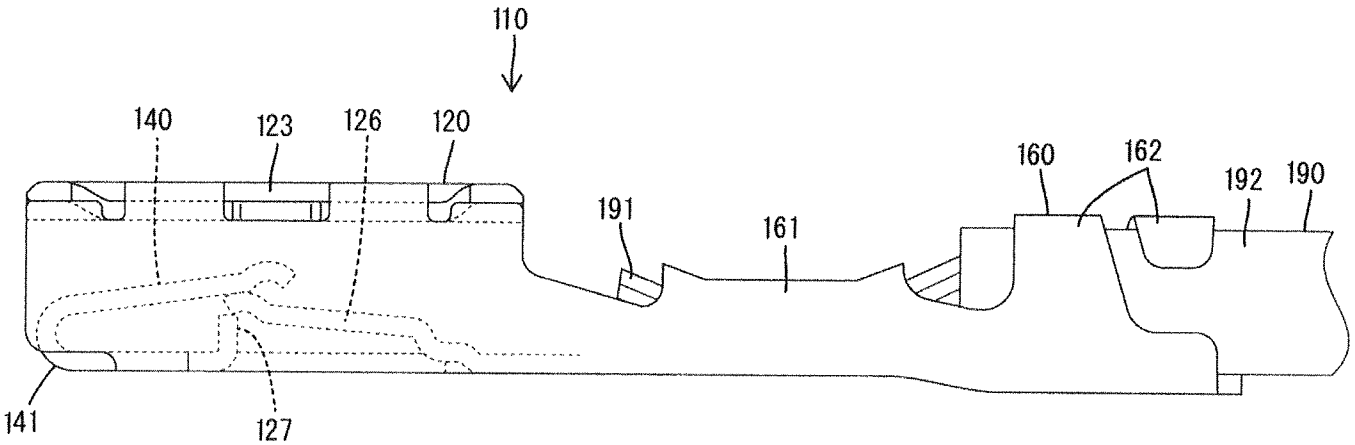
FIG. 10 is a side view of a terminal fitting according to a third embodiment of the present invention.

As shown in FIG. 10, the barrel 160 is on the rear of the terminal fitting 110 and comprises a wire barrel 161 to be crimped, folded or bent into connection with an exposed end portion of a core 191 of a wire 190 and at least one insulation barrel 162 behind the wire barrel 16 to be crimped, folded or bent into connection with an insulation coating 192 near the end of the wire 190.

Figure 11:
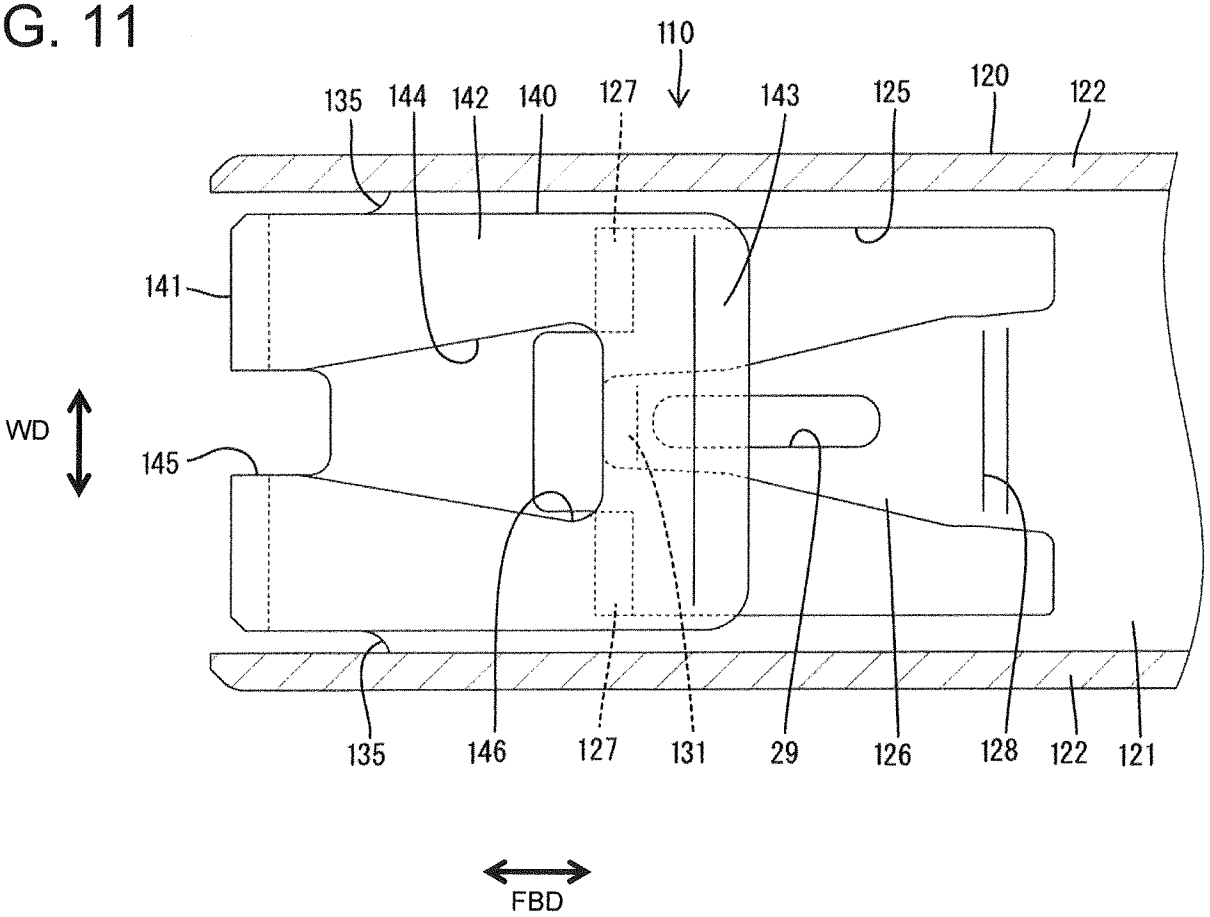
FIG. 11 is a plan view in section of a main portion.
Figure 12:
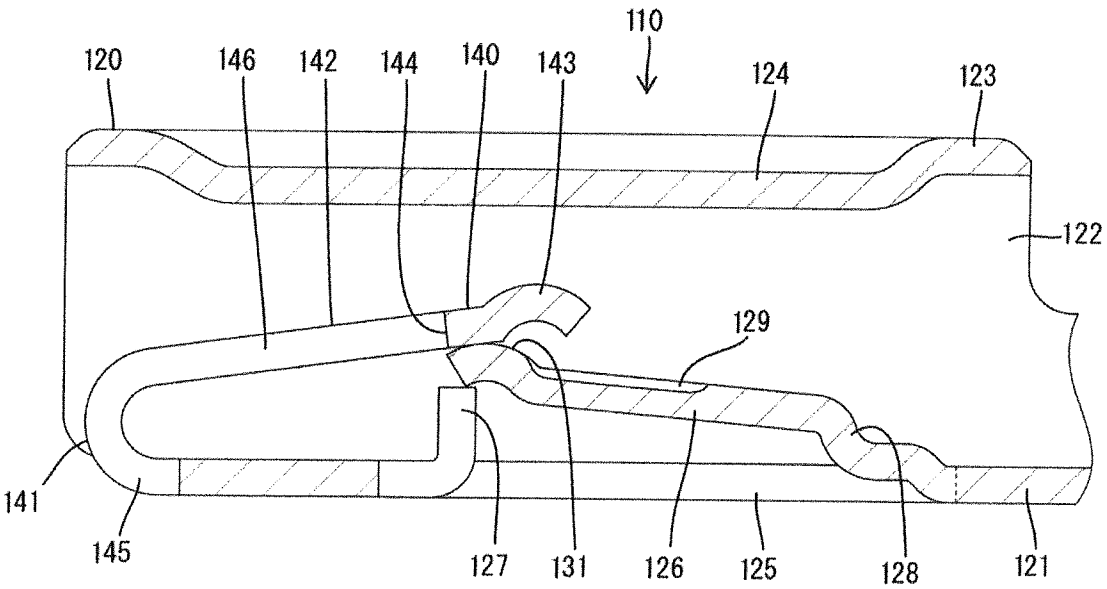
FIG. 12 is a side view in section of the main portion.
Figure 13:
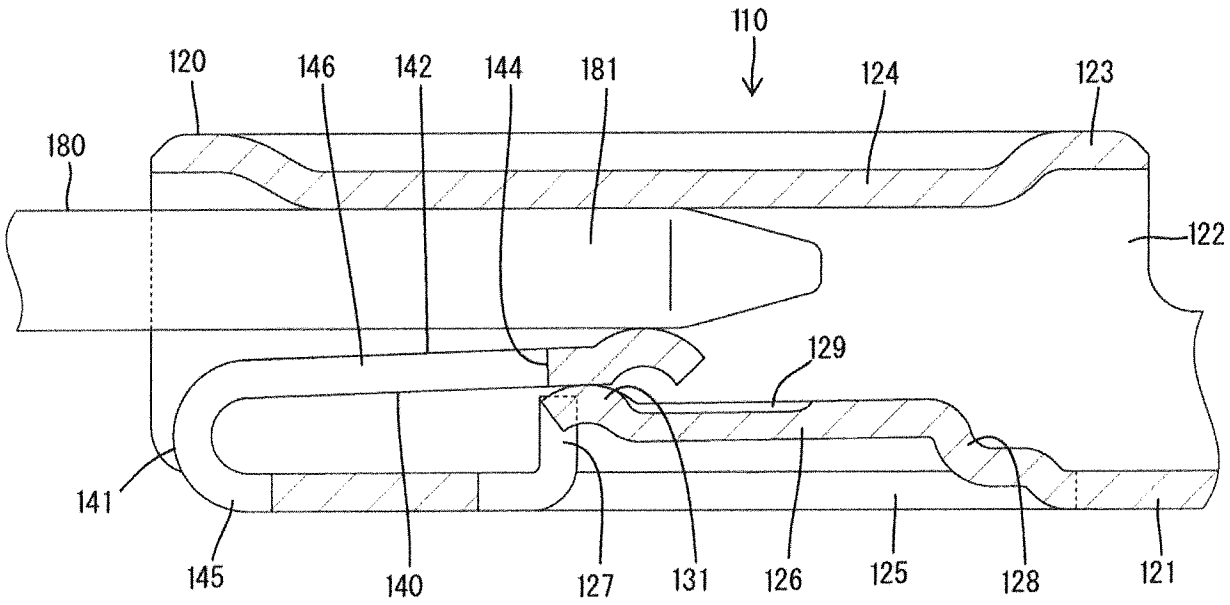
FIG. 13 is a side view in section of the main portion into which a male tab is inserted.

The main portion 120 is a substantially rectangular tube and, as shown in FIGS. 11 and 12, has a substantially flat bottom plate 121 connected to and extending from the wire barrel 160. Side plates 122 project up from opposite widthwise sides of the bottom plate 121 and a ceiling plate 123 extends from the upper end of one side plate 122 to the upper end of the other side plate 122. As shown in FIG. 13, a male tab 191 of a mating terminal fitting 180 is insertable into the main portion 120. The male tab 181 is a substantially flat plate having a width slightly smaller than the entire within of the interior of the main portion 120 and larger than a through hole 144 to be described later. The ceiling plate 123 is formed with a receiving portion 124 that can contact the upper surface of the male tab 181. The receiving portion 124 is a substantially trapezoidal rib that is long and narrow in forward and backward directions FBD and projects into the main portion 120 by striking, hammering and/or embossing.

As shown in FIG. 11, a punched hole 125 penetrates the bottom plate 121 to form a second resilient piece 126 and two excessive deformation preventing pieces 127. The second resilient piece 126 supplements a spring force of the first resilient piece 140 to be described later and the excessive deformation preventing pieces 127 prevents excessive deformation of the first resilient piece 140. The second resilient piece 126 and the excessive deformation preventing pieces 127 are bent to be raised into the main portion 120 from the punched hole 125.

The second resilient piece 126 is cantilevered obliquely up and in to the front from the rear end of the punched hole 125, as shown in FIG. 12, and becomes gradually narrower from a rear end toward a front end, as shown in FIG. 11. The rear end of the second resilient piece 126 is bent a plurality of times to form at least one step 128. Further, at least one groove 129 is formed in a front part of the second resilient piece 126 and is substantially long and narrow in forward and backward directions FBD. An arcuate support 131 is formed at the front end of the second resilient piece 126 and contacts the lower surface of the first resilient piece 140. The male tab 181 deforms the first resilient piece 140 down, as shown in FIG. 13, and the first resilient piece 140 presses the support 131 down toward the bottom plate 121. Accordingly, the second resilient piece 126 is deformed resiliently down with the rear end thereof as a support.

As shown in FIG. 11, the excessive deformation preventing pieces 127 are adjacent to the first resilient piece 140 and are on opposite front corners of the punched hole 125 in a width direction WD and adjacent to the opposite widthwise sides of the front end portion of the second resilient piece 126. The excessive deformation preventing pieces 127 are substantially rectangular plates that stand substantially vertically.

As shown in FIG. 12, the first resilient piece 140 comprises a support 141 of substantially semicircular cross-section connected to the front end of the bottom plate 121 and a resilient main body 142 that is cantilevered obliquely up and in to the back from the support 141. As shown in FIG. 11, the first resilient piece 140 has a constant width over the entire length in forward and backward directions FBD and is shaped to be wide while forming small clearances between the resilient piece 140 and the side plates 122 of the main portion 120. Two slits 135 are formed between the resilient piece 140 and the side plates 122 of the main portion 120 at outer widthwise sides of the support 141.

As shown in FIGS. 11 and 12, the support 131 contacts a substantially widthwise central portion of a rear end of the resilient main body 142 from below and a contact 143 is formed at a position immediately before the support 131 for contacting the lower surface of the male tab 181. The contact 143 is bent to be convex upward over substantially the entire width of the resilient main body 142. The male tab 181 slides on the contact 143 while inserting the male tab 181 into the main portion 120 and causes the first resilient piece 140 to deform resiliently down about the support 141 and toward the bottom plate 121 together with the second resilient piece 126. The properly inserted male tab 181 is sandwiched resiliently between the contact 143 and the receiving portion 124, as shown in FIG. 13. Thus, the terminal fittings 110, 180 are connected electrically. Further, the excessive deformation preventing pieces 127 can contact opposite widthwise sides of the rear end of the resilient main body 142.

As shown in FIG. 11, the through hole 144 penetrates the resilient piece 142 while leaving the opposite widthwise sides and the rear end of the resilient main body 142. Specifically, the through hole 144 comprises a narrow through hole 145 of uniform width that penetrates a widthwise central portion of the support 141 over substantially the entire height and a wide through hole 146 that penetrates a widthwise central portion of the resilient main body 142 while being gradually widened in the width direction WD from a base end toward the back. The rear end of the wide through hole 146 is at substantially the same position as the front end of the second resilient piece 126 in forward and backward directions FBD and is wider than the front end of the second resilient piece 126. The through hole 144 gives the first resilient piece 140 an arched shape from the opposite widthwise sides to the rear end.

The male tab 181 slides along the contact 143 of the first resilient piece 140 as the male tab 181 is inserted into the main portion 120 from the front, as shown in FIG. 13, to connect the terminal fittings 110, 180 electrically conductively. Thus, the first resilient piece 140 deforms resiliently about the support 141 and the second resilient piece 126 pressed by the first resilient piece 140 to deform resiliently about the rear end.

The male tab 181 is supported stably along the width direction WD by the wide rear end of the first resilient piece 140 and will not incline about an axis. In addition, the through hole 144 penetrates through the support 141 and becomes gradually wider toward the back. Thus, a resilient reaction force applied to the male tab 181 from the first resilient piece 140 is adjusted properly without becoming too large. Further, the second resilient piece 126 contacts the widthwise central portion of the rear end of the first resilient piece 140 for resiliently supporting the rear end of the first resilient piece 140 from below. Thus, posture stability of the rear end of the first resilient piece 140 is good and the male tab 181 is supported more stably.

The male tab 181 or unillustrated external matter may enter the main portion 120 and contact the first resilient piece 140 in an oblique direction. This contact could deform the first resilient piece 140 beyond a proper amount of resilient deformation. However, the excessive deformation preventing pieces 127 contact opposite widthwise sides of the rear end of the first resilient piece 140 from below to prevent excessive deformation. Further, the excessive deformation preventing pieces 127 contact the opposite widthwise sides of the rear portion of the first resilient piece 140 to ensure posture stability of the rear end of the first resilient piece 140 when the first resilient piece 140 is about to be excessively deformed. The excessive deformation preventing pieces 127 are adjacent to opposite widthwise sides of the narrow front portion of the second resilient piece 126 and the excessive deformation preventing pieces 127 and the second resilient piece 126 are bent from the same punched hole 125. Hence, space efficiency is improved and the miniaturization of the terminal fitting 110 can be realized.

The invention is not limited to the above embodiment and may be embodied as follows.

The second resilient piece may be omitted.

Two excessive deformation preventing pieces may project into the main portion from the opposite side plates.

The through hole may be formed at a position deviated from the widthwise central portion of the first resilient piece.

Figure 19:
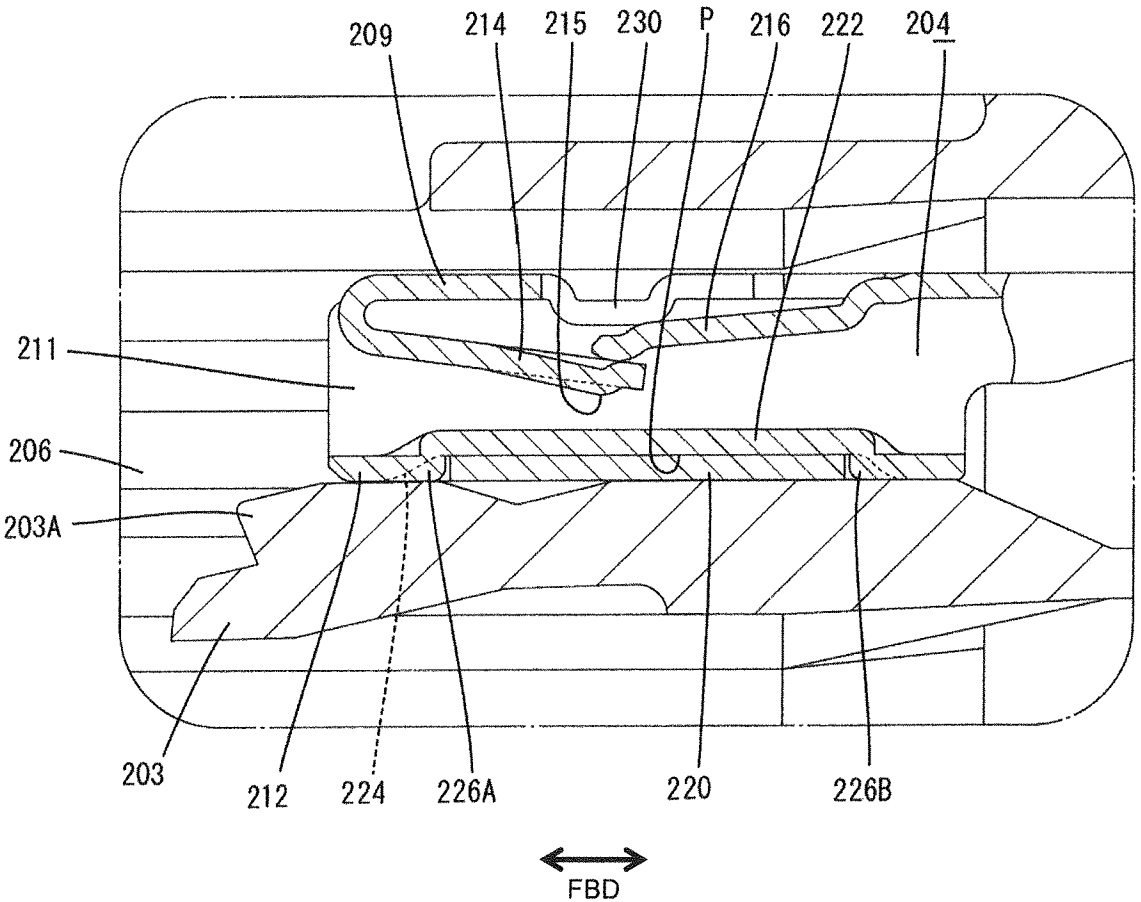
FIG. 19 is a section showing an intermediate state of the terminal fitting being inserted into a cavity.
Figure 20:
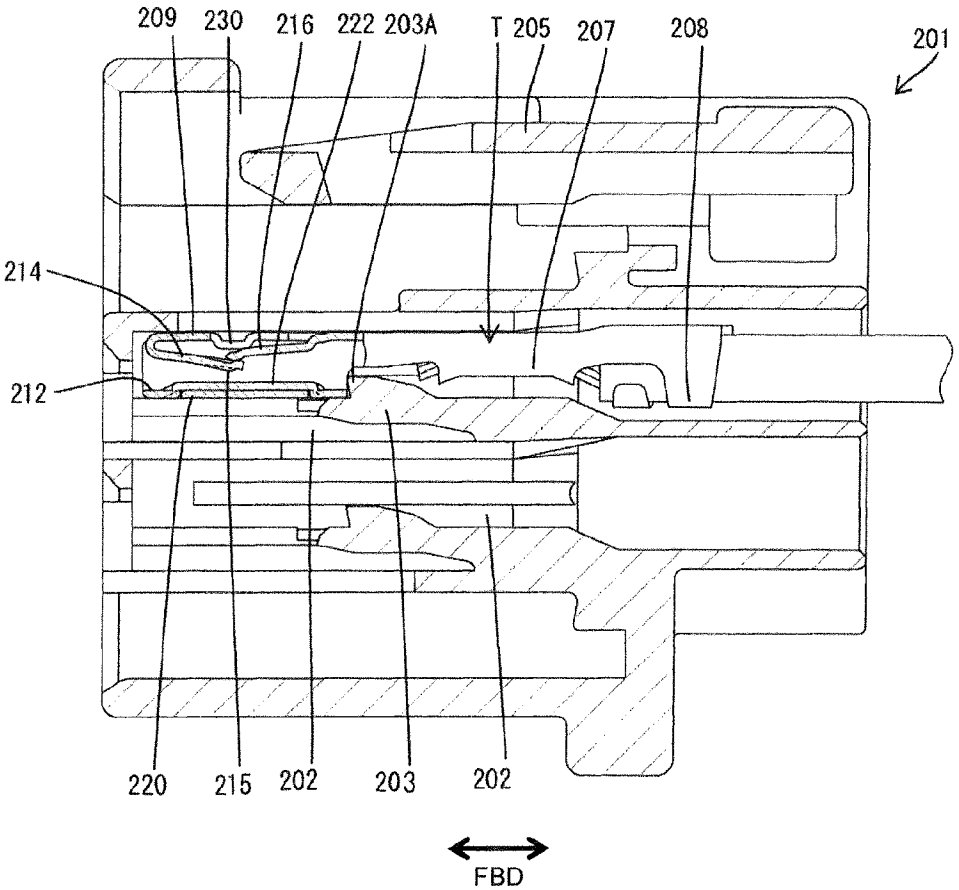
FIG. 20 is a section showing a completely inserted state of the terminal fitting.

A fourth embodiment of the invention is described with reference to FIGS. 14 to 20. A terminal fitting T according to the fourth embodiment is accommodated in a housing 201. As shown in FIG. 20, cavities 202 are formed in upper and lower levels in the housing 201 and penetrate the housing 201 in forward and backward directions. The terminal fitting T is insertable into the cavity 202 from behind and a mating terminal fitting 227 is insertable therein from the front. A resiliently deformable locking lance 203 is formed in each cavity 202 and can deform in a direction substantially perpendicular to an inserting direction of the terminal fitting T. The outer surface of a substantially rectangular tube 204 of the terminal fitting T slides in contact with the locking lance 203 and resiliently deforms the locking lance 203 in the process of inserting the terminal fitting T. The locking lance 203 passes over the rectangular tube 204 and resiliently restores when the terminal fitting T is inserted to a proper depth in the cavity 202. As a result, a locking projection 203A of the locking lance 203 engages the rear end of the tube 204 to retain the terminal fitting T. Note that the locking lance 203 may come into contact with another portion of the terminal fitting T (e.g. a recess or hole in the tube 204) to lock the properly inserted terminal fitting. A lock arm 205 for locking the housing 201 to an unillustrated mating connector is formed on the upper surface of the connector housing 201.

Figure 18:
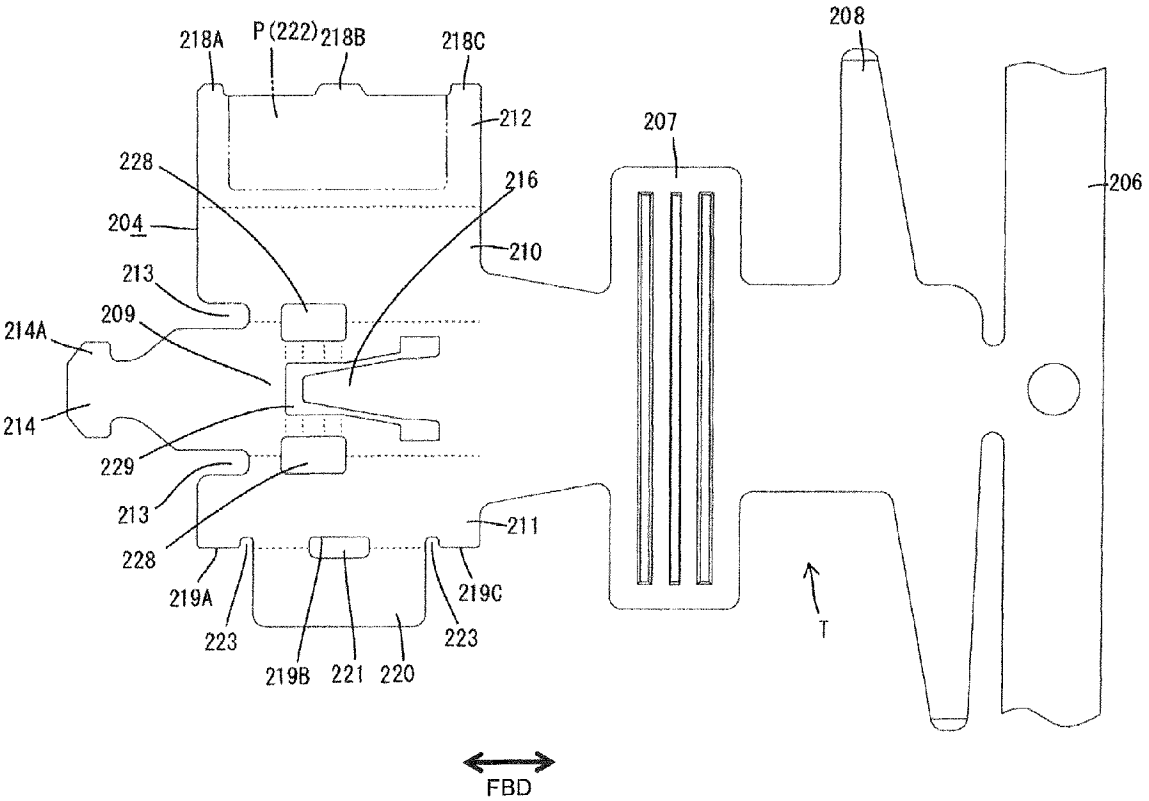
FIG. 18 is a development of the terminal fitting.

FIG. 18 shows the terminal fitting T of this embodiment in a developed state after being punched or cut out into a specified shape from a flat conductive metal plate material. Although not shown in detail, a multitude of terminal fittings T in the developed state are coupled to a carrier 206 in a chain-like manner substantially in a longitudinal direction. Each terminal fitting Tin the developed state is cut off or separated from the carrier 206 to become the terminal fitting T having a desired shape after processes such as bending, folding, embossing and/or striking or hammering or stamping.

Figure 14:
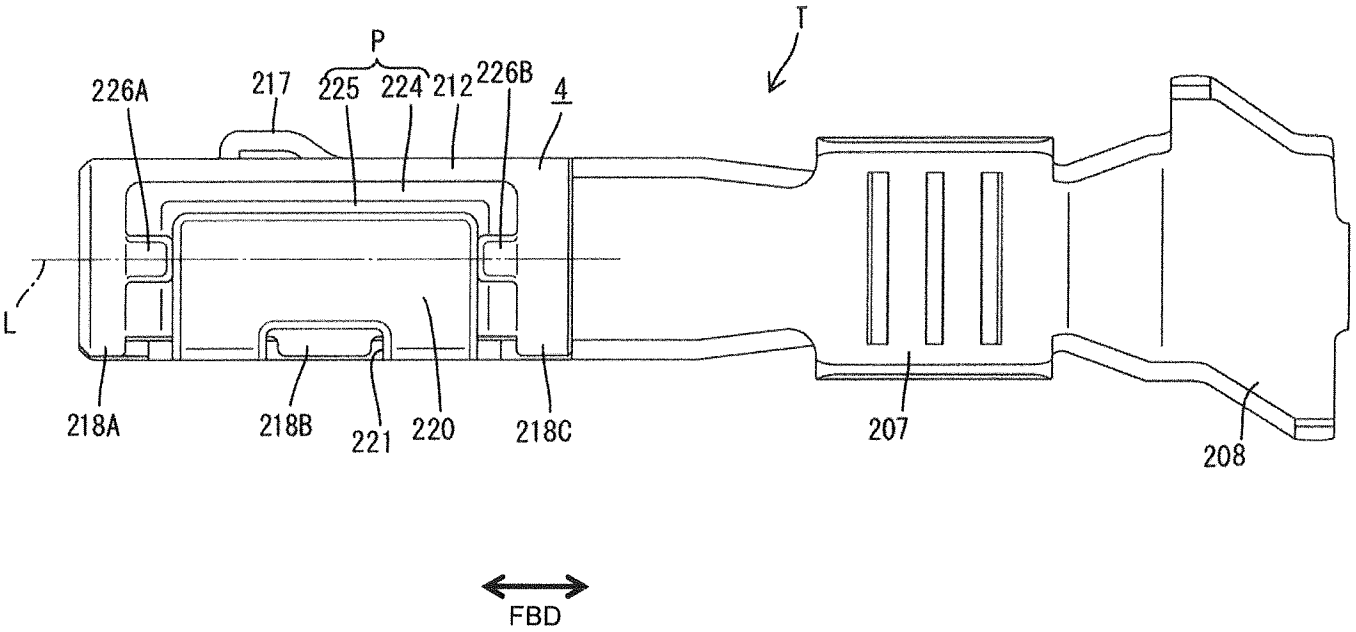
FIG. 14 is a plan view of a terminal fitting.
Figure 15:
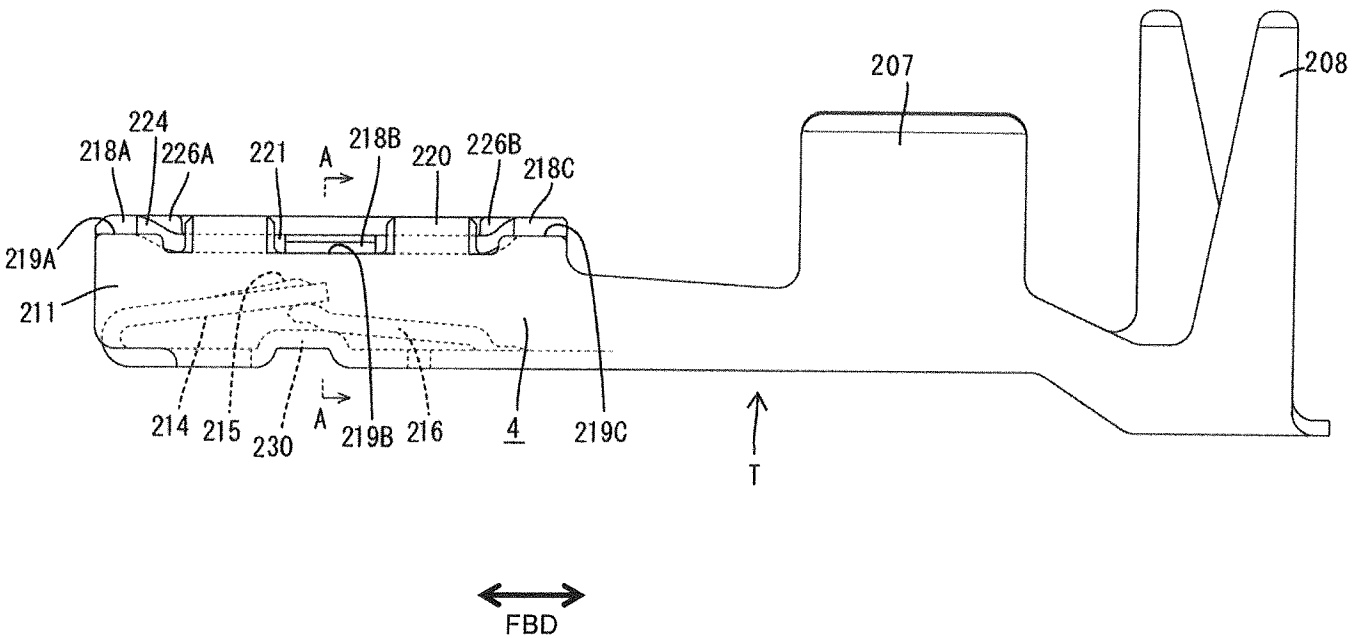
FIG. 15 is a side view of the terminal fitting.

As shown in FIGS. 14 and 15, the (particularly substantially rectangular or polygonal) tube portion 204 hollow in forward and backward directions is formed on the front of the terminal fitting T, and a wire connection portion to be connected to a wire (particularly comprising at least one wire barrel 207 to be crimped and connected to a wire core and at least one insulation barrel 208 to be crimped and connected to an insulation coating) are formed on the rear of the terminal fitting T.

Figure 16:
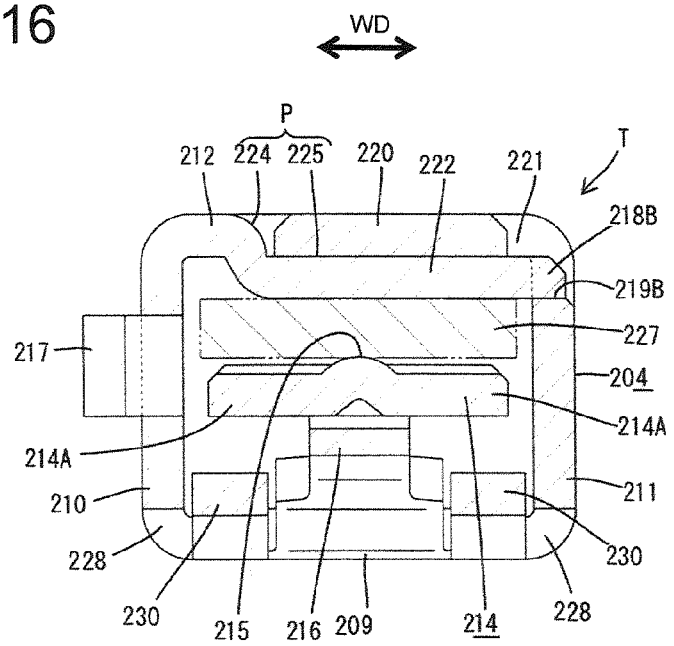
FIG. 16 is a section along A-A of FIG. 15.

As shown in FIG. 16, the substantially rectangular tube 204 comprises a bottom plate 209, a first side plate 210, a second side plate 211, a ceiling plate 212 and a pressing portion 220. As shown in FIG. 18, laterally spaced grooves 213 are formed on the front edge of the bottom plate 209 and a tongue 214 extends forward between the grooves 213 for contacts the lower surface of the mating terminal 227 (see FIG. 16). The tongue 214 is folded back into the tube 204, as shown in FIGS. 15 and 20. A folded part is bent arcuately and the tongue 214 is resiliently deformable in a height direction with the folded part as a support. A contact 215 is formed on the upper or inner surface of the tongue 214 by striking or embossing.

As shown in FIGS. 15 and 18, an auxiliary spring 216 is provided in a widthwise central part of the bottom plate 209 by cutting and bending and is resiliently deformable in the vertical direction toward and away from the bottom plate 209. The auxiliary spring 216 extends forward and the leading end thereof is constantly in contact with a leading end portion of the tongue 214. Further, as shown in FIG. 18, two openings 228 are formed in boundary parts between the bottom plate 209 and the first and second side plates 210, 211. As shown in FIGS. 19 and 20, excessive deformation preventing portions 230 project from the bottom plate 209 adjacent to the auxiliary spring piece 216, particularly in parts between the openings 228 and a punched hole 229 from which the auxiliary spring piece 216 is raised. The excessive deformation preventing portions 230 prevent excessive deformation of the tongue 214 and are bent to have a crank shape projecting into the tube 204. As shown in FIG. 16, the excessive deformation preventing portions 230 are arranged below respective expanding portions 214A expanded in the width direction at the leading end of the tongue 214. The excessive deformation preventing portions 230 do not contact the lower surfaces of the expanding portions 214A when the tongue 214 is deformed resiliently within a normal range (e.g. due to normal insertion of the mating terminal). However, the excessive deformation preventing portions 230 contact the lower surfaces of the expanding portions 214A to restrict deformation of the tongue 214 beyond this normal range.

Figure 17:
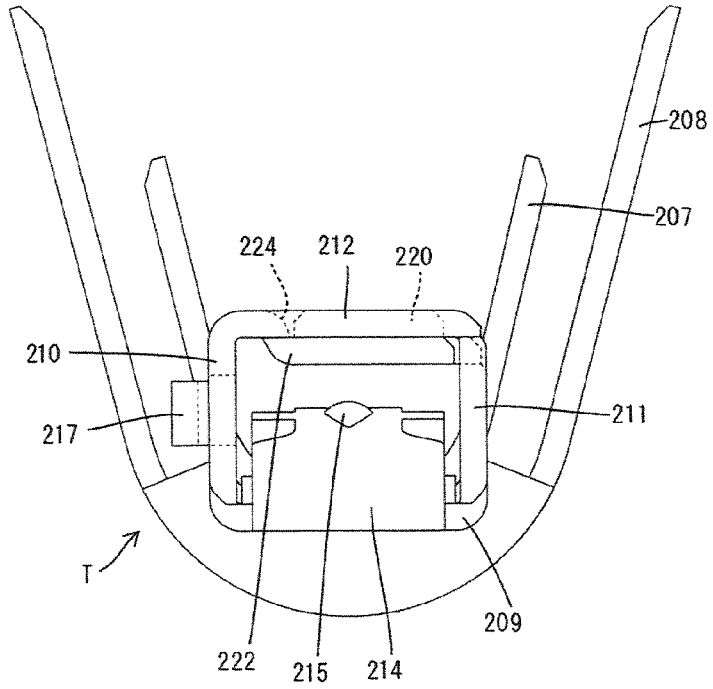
FIG. 17 is a front view of the terminal fitting.

As shown in FIGS. 16 and 17, the first side plate 210 projects at a substantially right angle from the left side of the bottom plate 209 and the second side plate 211 projects at a substantially right angle from the right, edge of the bottom plate 209. A stabilizer 217 projects out in the width direction WD from a substantially central part of the first side plate 210 in the height direction and the longitudinal direction for preventing insertion in an improper posture (such as upside-down insertion).

The ceiling plate 212 extends from the upper end of the first side plate 210 toward the second side plate 211 substantially parallel to the bottom plate 209. As shown in FIG. 18, three projecting pieces 218A to 218C project outwardly in the width direction WD of the ceiling plate 212, particularly on front and rear end parts and a central part of the extending end edge of the ceiling plate 212 in the longitudinal direction. Front and rear receiving portions 219A, 219C are formed on front and rear end parts of the upper end of the second side plate 211 and receive from above the projecting pieces 218A, 218C located on the front and rear ends of the ceiling plate 212. A pressing portion 220 for preventing the opening of the ceiling plate 212 is formed between the receiving portions 219A, 219C on the upper end of the second side plate 211.

As shown in FIG. 18, the pressing portion 220 is formed between recessed grooves 223 spaced apart in forward and backward directions FBD, and projects more outwardly than the receiving portions 219A, 219C in the width direction WD. The pressing portion 220 is bent at a substantially right angle from the upper end of the second side plate 211 and is placed on a flat surface 225 of a struck or deformed area P to be described later to come into contact from above. At least one window 221 is formed in a substantially central part of a boundary between the pressing portion 220 and the second side plate 211 in forward and backward directions FBD and is long in forward and backward directions FBD. The projecting piece 218B in the longitudinal intermediate position of the ceiling plate 212 is inserted into the window 221 and placed on the lower side of the opening edge of the window 221, which is a receiving portion 219B, to come into contact from above. Note that, as shown in FIG. 15, the receiving portion 219B in the longitudinal intermediate position is lower or more inward in the height direction than the receiving portions 219A, 219C before and after the receiving portion 219B by the plate thickness.

As shown in FIGS. 16 and 17, the ceiling plate 212 is formed with a ceiling plate contact 222 for the mating terminal 227. The ceiling plate contact 222 can contact the mating terminal 227 while sandwiching the mating terminal 227 between the tongue contact 215 and the ceiling plate contact portion 222.

The ceiling plate contact 222 is formed by striking, hammering, stamping, embossing or otherwise deforming an area of the ceiling plate 212 into the tube 204 as indicated by imaginary line in FIG. 18. The struck area P extends between the front and rear projecting pieces 218A, 218C in forward and backward directions FBD and from the extending edge of the ceiling plate 212 to the vicinity of the upper end of the first side plate 210 in the width direction WD, as shown in FIG. 18. As shown in FIG. 16, a peripheral part (part along imaginary line in FIG. 18) in this struck area P is an R-surface 224 and the flat surface 225 is inward of the R-surface 224. The R-surface 224 is formed on the peripheral part excluding the extending end edge of the ceiling plate 212 and has a cross-sectional shape curved inwardly. The flat surface 225 is horizontal and substantially parallel to the bottom plate 209 and the pressing portion 220 can contact substantially the entire flat surface 225. Accordingly, a gap equivalent to the width of the R-surface 224 is formed between the end edge of the pressing portion 220 and the peripheral edge of the struck area P.

The depth of the struck area P is substantially equal to the plate thickness of the walls forming the tube 204. Thus, the upper surface of the pressing portion 220 is substantially flush with that of the ceiling plate 212 when the flat surface 225 is pressed by the pressing portion 220.

A line L in FIG. 14 indicates a slide contact path along which a widthwise central portion of the locking lance 203 (locking projection 203A) slides in contact with the upper surface of the rectangular tube 204 in the process of inserting the terminal fitting T into the cavity 202. In this embodiment, the slide contact path L passes a substantially widthwise central portion of the rectangular tube 204.

Front and rear bridges 226A, 226B are formed on or at the R-surface 224 on this slide contact path L. The bridges 226A, 226B are formed by being struck in a direction substantially opposite to a striking direction of the struck area P, i.e. in a direction outward of the tube 204. The bridges 226A, 226B have widths in forward and backward directions FBD to fill the gap between the peripheral opening edge of the ceiling plate 212 and the respective end edge of the pressing portion 220 and to be substantially continuous with the ceiling surfaces of the ceiling plate 212 and the pressing portion 220. Further, the upper surfaces of the bridges 226A, 226B are substantially horizontal, substantially rectangular and substantially flush with the upper surfaces of the ceiling plate 212 and the pressing portion 220. Both bridges 226A, 226B are formed through a striking process of striking parts, where the bridges 226 are to be formed from the opposite side after the struck area P is formed on the ceiling plate 212, i.e. after the R-surface 224 is formed.

The terminal fitting T is inserted into the cavity 202 from behind in a posture so that the ceiling plate 212 faces down. Then, as shown in FIG. 19, the outer surface of the ceiling plate 212 of the rectangular tube 204 of the terminal fitting T slides in contact with the locking lance 203 and deforms the locking lance 203 resiliently down or out.

Sufficient insertion of the terminal fitting T causes the locking projection 203A of the locking lance 203 to pass on the outer surface of the rectangular tube 204 from the front end toward the rear end along the slide contact path L shown in FIG. 14. During this time, the locking projection 203A of the locking lance 203 slides in contact with a front part of the ceiling plate 212, passes on the front bridge 226A and reaches the pressing portion 220. The locking projection 203A then passes on the rear bridge 226B and moves onto the ceiling plate 212. When the locking projection 203A passes the tube 204 in this way, the locking lance 203 resiliently restores to engage the rear end of the tube 204.

The bridges 226A, 226B fill the gap between the pressing portion 220 and the ceiling plate 212 and are substantially continuous with upper surfaces of the ceiling plate 212 and the pressing portion 220. Thus, the locking projection 203A moves smoothly along the slide contact path L without dropping being caught in the gap between the ceiling plate 212 and the pressing portion 220. Further, the bridges 226A, 226B are flush with the pressing portion 220 and the ceiling plate 212. Thus, the deformed amount of the locking lance 203 is substantially constant during the insertion so that insertion resistance hardly changes and the terminal fitting T can be inserted smoothly.

The bridges 226A, 226B are formed easily by striking parts of the R-surface 224 in the struck area P in the opposite direction. Furthermore, the bridges 226A, 226B are at positions to hold the pressing portion 220 therebetween from front and rear sides so that the pressing portion 220 will not displace in forward and backward directions.

If the struck area P is made narrower in the width direction than in this embodiment and the slide contact path L is deviated from the struck area P, the locking lance 203 is not caught. However, if such a configuration is adopted, the pressing portion 220 becomes narrower as the struck area P is made narrower. As a result a function of preventing the opening of the ceiling plate 212 is reduced. In this embodiment, the locking lance 203 is not caught even if the wide struck area P is set to such an extent that the slide contact path L passes therethrough. Thus, an effect of being able to improve the function of preventing the opening of the ceiling plate 212 also is obtained.

The invention is not limited to the above described embodiment. For example, the following embodiments are also included in the scope of the invention.

The upper surfaces of the pressing portion 220 and the ceiling plate 212 are substantially flush with each other in the above embodiment. However, the depth of the struck area P may exceed the plate thickness so that the upper surface of the pressing portion 220 is lower than that of the ceiling plate 212. In that case, the upper surfaces of the bridges 226A, 226B preferably are smoothly inclined surfaces extending from the upper surface of the ceiling plate 212 to that of the pressing portion 220.

Although the bridges 226A, 226B are formed by being struck in the opposite direction after the struck area P is formed in the above embodiment, it is also possible to form the struck area P excluding the bridges 226A, 226B. By doing so, it is sufficient to perform the striking step once.

Figure 23:
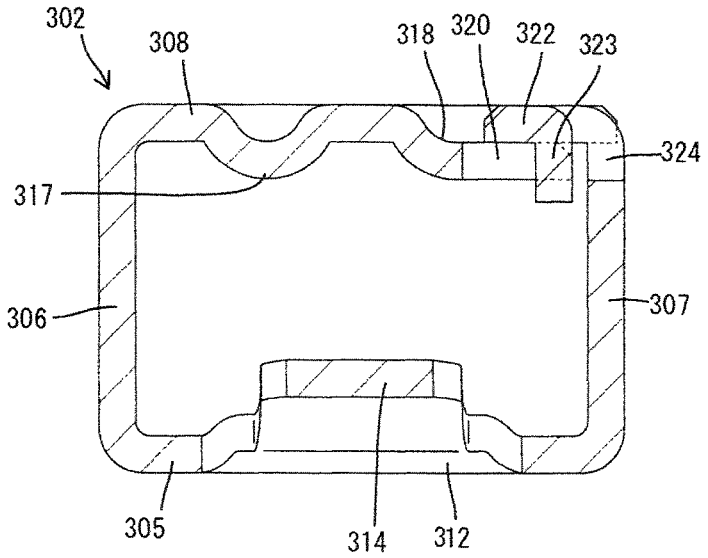
FIG. 23 is a section along B-B of FIG. 21.
Figure 24:
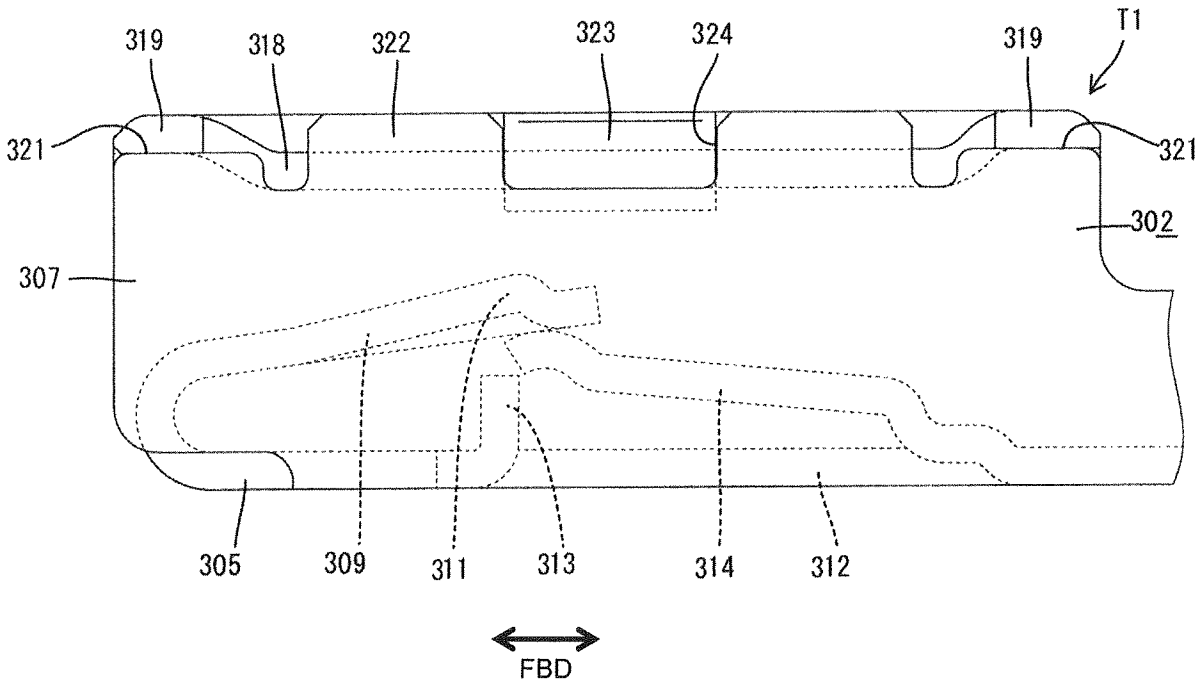
FIG. 24 is a side view of the terminal fitting.
Figure 25:
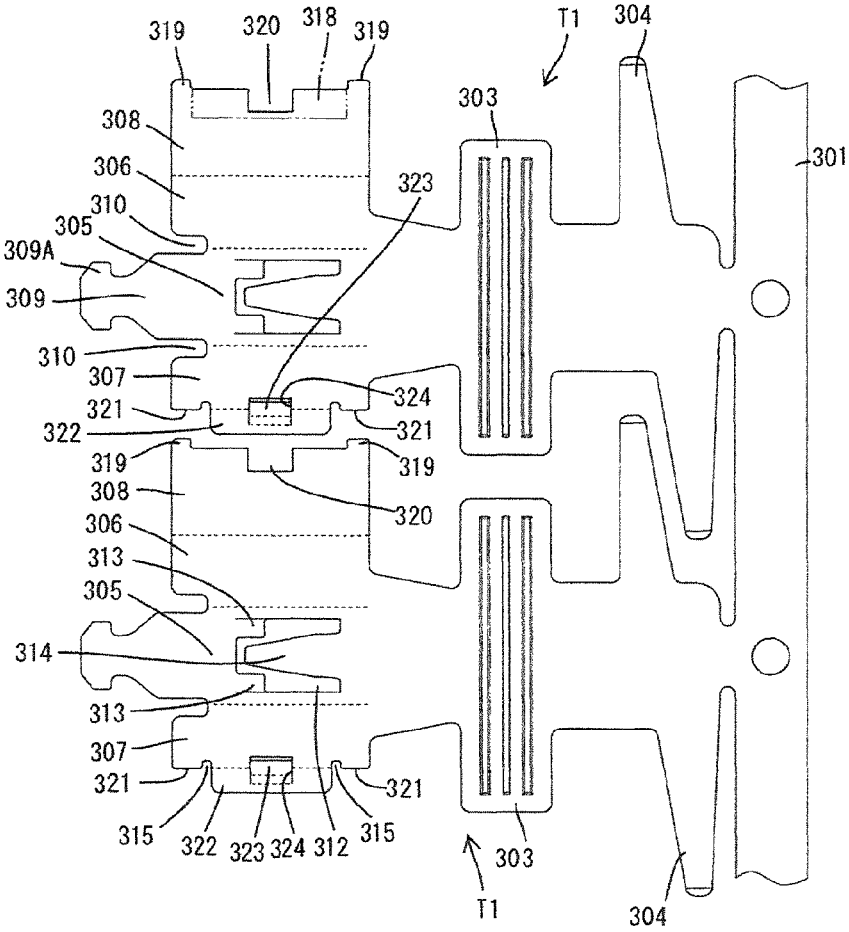
FIG. 25 is a development of the terminal fitting.

FIGS. 21 to 25 show a female terminal fitting according to a fifth embodiment of the invention. As shown in FIG. 25, a multitude of terminal fittings T1 according to the fifth embodiment are coupled to a carrier 301 in a chain-like manner substantially in a longitudinal direction. The terminal fitting T1 is in this developed state by being punched or cut out into a specified shape from a conductive metal flat plate material or blank. Each terminal fitting T1 in the developed state is cut off or separated from the carrier 301 to become the terminal fitting T1 having a desired shape after processes such as bending, folding, embossing, striking and/or stamping.

The front end of the formed terminal fitting T1 includes a substantially rectangular tube 302 that is hollow in forward and backward directions FBD. A wire barrel 303 is rearward of the tube 302 and is to be crimped, bent or folded into connection with a wire core. An insulation barrel 304 is formed on the rear of the terminal fitting T1 and is to be crimped, bent or folded connected to an insulation coating.

Figure 22:
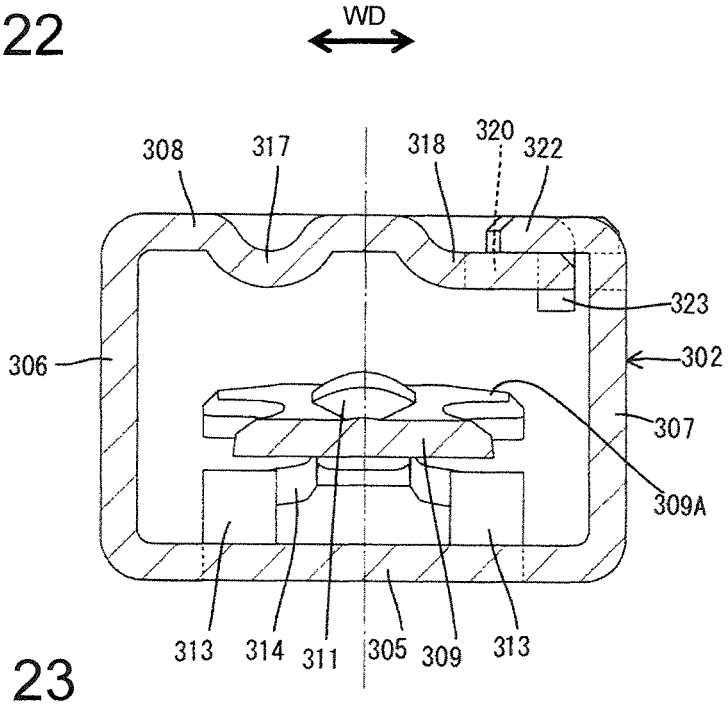
FIG. 22 is a section along A-A of FIG. 21.

As shown in FIGS. 22 and 23, the rectangular tube 304 comprises a bottom plate 305, a first side plate 306, a second side plate 307 and a ceiling plate 308. As shown in FIG. 25, a tongue 309 extends from the front of the bottom plate 305 and is bent back into the tube 304 for contacting an unillustrated tab of a male terminal fitting. Grooves 310 are formed adjacent to opposite widthwise sides of the tongue 309 at the front of the bottom plate 305, so that the tongue 309 can be folded back into the tube 302. As shown in FIG. 24, a folded part of the tongue 309 is curved arcuately and the tongue piece 309 is resiliently deformable in a height direction intersecting an insertion direction of the tab into the tube 304 with the folded part as a support. A tongue contact 311 is formed near the leading end on the upper or inner surface of the tongue 309 by striking, hammering or embossing. As shown in FIG. 22, the tongue contact 311 projects in a widthwise central portion on a center line with respect to the width direction WD of the tube 302 on the upper surface of the tongue 309. The tongue contact 311 is shaped to be pointed toward the front and to become gradually wider toward the rear.

As shown in FIG. 25, a substantially T-shaped punched hole 312 is formed in a central part of the bottom plate 305 in forward and backward directions FBD. Two excessive deformation preventing pieces 313 are arranged at opposite widthwise sides at the front of the opening edge of the punched hole 312. As shown in FIGS. 22 and 24, the excessive deformation preventing pieces 313 project at a substantially right angle into the interior of the tube 302 and can contact the lower surface of a wide portion 309B bulging laterally out near a leading end of the tongue 309 when the tongue 309 is deformed by a specified angle. The excessive deformation preventing pieces 313 have heights so as not to contact the tongue piece 309 when the mating terminal fitting is inserted in a proper posture. The punched hole 312 also serves as a lance hole for receiving a locking lance (not shown) formed in an unillustrated connector housing to lock the terminal fitting T1.

A resiliently deformable auxiliary spring piece 314 extends forward from the rear of the punched hole 312 and becomes gradually narrower toward the front. The front end of the auxiliary spring piece 314 projects arcuately up and may be held constantly in contact with the lower surface of the rear end of the tongue 309 or may be separated slightly in a natural state and come into contact after the start of resilient deformation of the tongue 309, as shown in FIG. 24.

Figure 21:
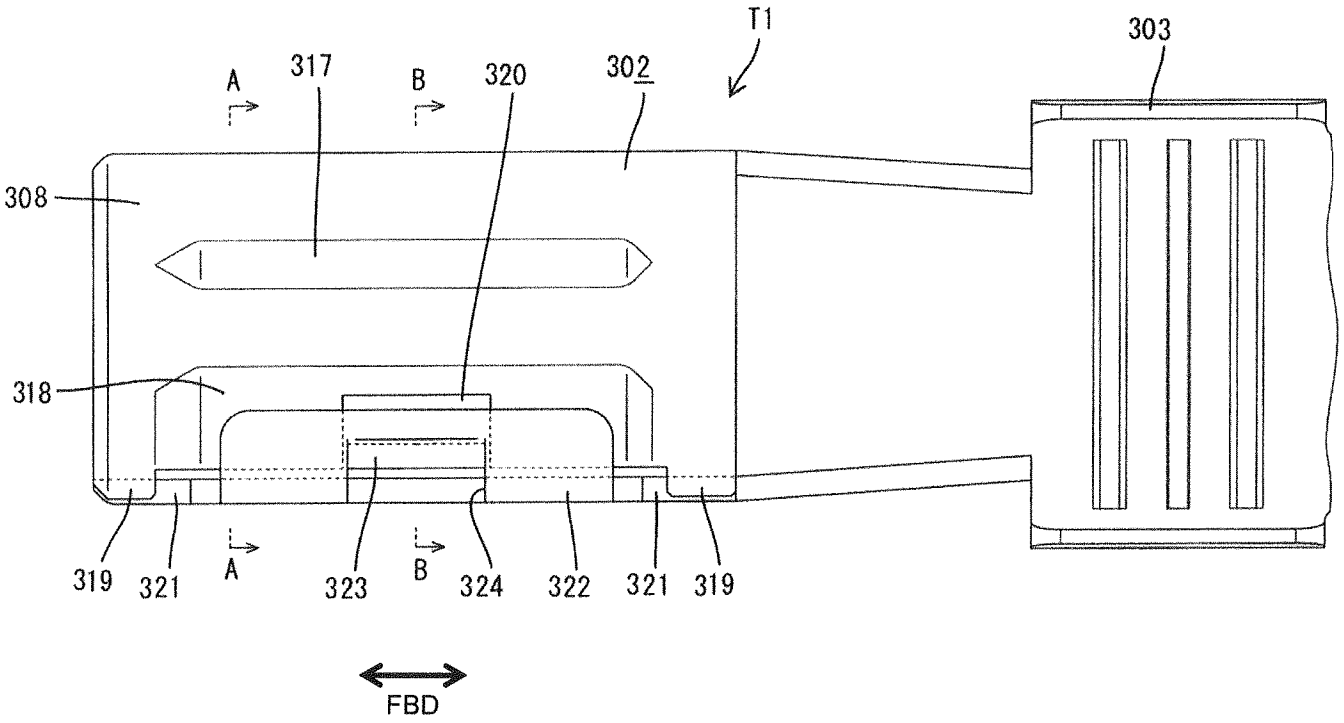
FIG. 21 is a plan view of a terminal fitting according to a first embodiment.

As shown in FIGS. 22 and 23, the first side plate 306 projects at a substantially right angle from the left side of the bottom plate 305 and the second side plate 307 projects at a substantially right angle from the right side of the bottom plate 305. The ceiling plate 308 is bent from the upper end of the first side plate 306 and extends toward the second side plate 307 substantially in parallel to the bottom plate 305. As shown in FIGS. 21 to 23, the ceiling plate 308 includes a ceiling plate contact 317 that can contact the mating terminal fitting. The ceiling plate contact 317 defines a rib struck or hammered to project into the tube 302. The ceiling plate contact 317 is closer to the first side plate 306 than a widthwise center on the ceiling plate 308 and extends over a specified length in forward and backward directions FBD. Further, the ceiling plate contact 317 has a substantially semicircular cross-section with a depth substantially equal to the plate thickness of walls of the rectangular tube 302.

An extending end part of the ceiling plate 308 is shaped, bent or struck inward of the rectangular tube 302 to form a struck portion 318. As shown in FIGS. 21 to 23, the struck portion 318 is at a side of a center line of the rectangular tube 302 opposite to the ceiling plate contact 317 and is formed over a substantially rectangular area that is long in the longitudinal direction (area enclosed by imaginary line in FIG. 25). The height of the inner surface of the struck portion 318 is substantially equal to that of the ceiling plate contact 317. Thus, both the inner surface of the struck portion 318 and the ceiling plate contact 317 can contact a facing surface of the mating terminal fitting. The height of the outer surface of the struck portion 318 is lower than surface in areas other than areas where the ceiling plate contact 317 and the struck portion 318 are formed by a height equivalent to the plate thickness.

As shown in FIG. 25, two projecting pieces 319 project out in the width direction WD on the ceiling plate 308 at opposite longitudinal ends of the extending end edge of the ceiling plate 308. The struck portion 318 is formed between the projecting pieces 319. Further, an opening 320 is provided on a widthwise side edge of the struck portion 318, which is the extending end edge of the ceiling plate 308. The opening 320 is formed by making a substantially rectangular cutout in a central part of the side edge of the struck portion 318 in forward and backward directions FBD.

Receiving portions 321 are formed on front and rear end parts of the rising end of the second side plate 307 for supporting the respective projecting pieces 319 of the ceiling plate 308. A pressing portion 322 projects out in the width direction WD between the receiving portions 321 on the second side plate 307. Further, recessed grooves 315 are formed at front and rear ends of the pressing portion 322 and the pressing portion 322 is bent at a substantially right angle at the rising end of the second side plate 307 and is placed on the upper or outer surface of the struck portion 318. The pressing portion 322 prevents the opening of the ceiling plate 308 and hence the opening of the entire rectangular tube 302.

A substantially U-shaped cut 324 crosses over the bending edge of the pressing portion 322 in an intermediate part of the pressing portion 322 in forward and backward directions FBD. An inner area of this U-shaped cut 324 forms a displacement preventing portion 323. As shown in FIG. 25, the displacement preventing portion 323 is at a position spaced inward in the width direction WD from the widthwise side edge of the pressing portion 322 (extending end edge of the second side plate 307). Further, the width of the displacement preventing portion 323 in forward and backward directions FBD is slightly smaller than that of the opening 320 in forward and backward directions FBD.

Further, as shown in FIGS. 23 and 25, the displacement preventing portion 323 is bent at a substantially at a right angle inward of the tube 302 substantially with a part near and parallel to the widthwise side edge of the pressing portion 322 as the bending edge. In a bent state, the displacement preventing portion 323 is inserted in the opening 320 from above and the front and rear edges thereof engage with the front and rear opening edges of the opening 320 so that the pressing portion 322 and the ceiling plate 308 cannot be displaced in forward and backward directions FBD. As shown in FIG. 23, the lower end of the displacement preventing portion 323 is below or inward of the inner surface of the struck portion 318 with the displacement preventing portion 323 locked in the opening 320.

When the terminal fittings T1 in the developed state are coupled to the carrier 301, as shown in FIG. 25, the pressing portion 222 is between the projecting pieces 319 of the adjacent terminal fitting T1 and the widthwise end edge of the pressing portion 322 and the extending end edge of the ceiling plate 308 extend in substantially forward and backward directions and face each other at most proximate positions.

The terminal fitting T1 of the fifth embodiment is configured so that relative displacements of the pressing portion 322 and the ceiling plate 308 in forward and backward directions FBD are prevented since the displacement preventing portion 323 is inserted into the opening 320 and the front and rear edges thereof engage the front and rear sides of the opening edge of the opening 320. Therefore, the rectangular tube 302 can be maintained in a proper shape even if being subjected to an external force.

The displacement preventing portion 323 is spaced inwardly from the extending end edge of the pressing portion 322 and the displacement preventing portion 323 does not project outwardly in the width direction WD as before. Thus, as shown in FIG. 25, a distance between the extending end edge of the pressing portion 322 and that of the ceiling plate 308 can be shortened between the adjacent terminal fittings T1. Therefore, cutting layout of the terminal fittings T1 is excellent, which can contribute to a yield improvement.

The terminal fitting T1 of the fifth embodiment has the struck portion 318, and the pressing portion 322 is placed on the slightly lowered ceiling plate 308. Thus, the pressing portion 322 does not project out from the ceiling plate 308 so that the height of the terminal fitting T1 is reduced. Further, the opening 320 is below the pressing portion 322 and the displacement preventing portion 323 is locked therein. Therefore, the displacement prevention structure is accommodated within the height range of the rectangular tube 302, thereby contributing to a reduced height of the terminal fitting T1.

Figure 26:
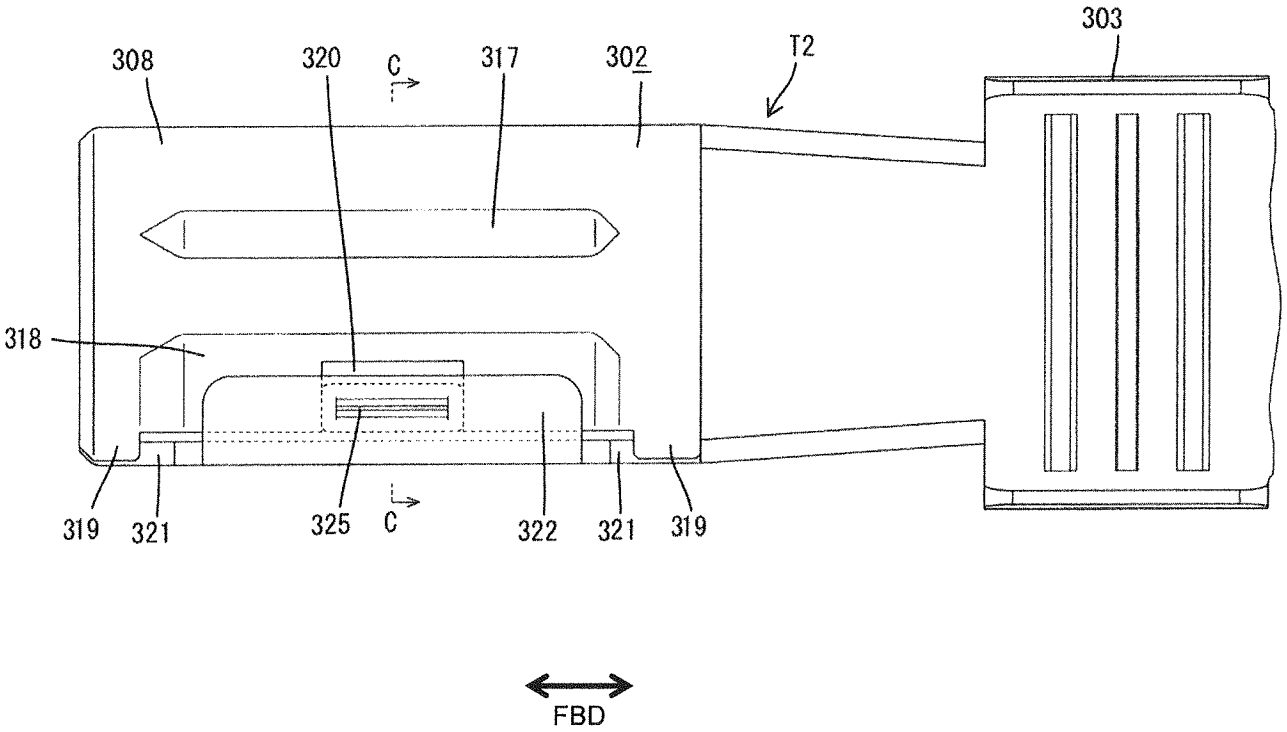
FIG. 26 is a plan view of a terminal fitting according to a second embodiment.
Figure 27:
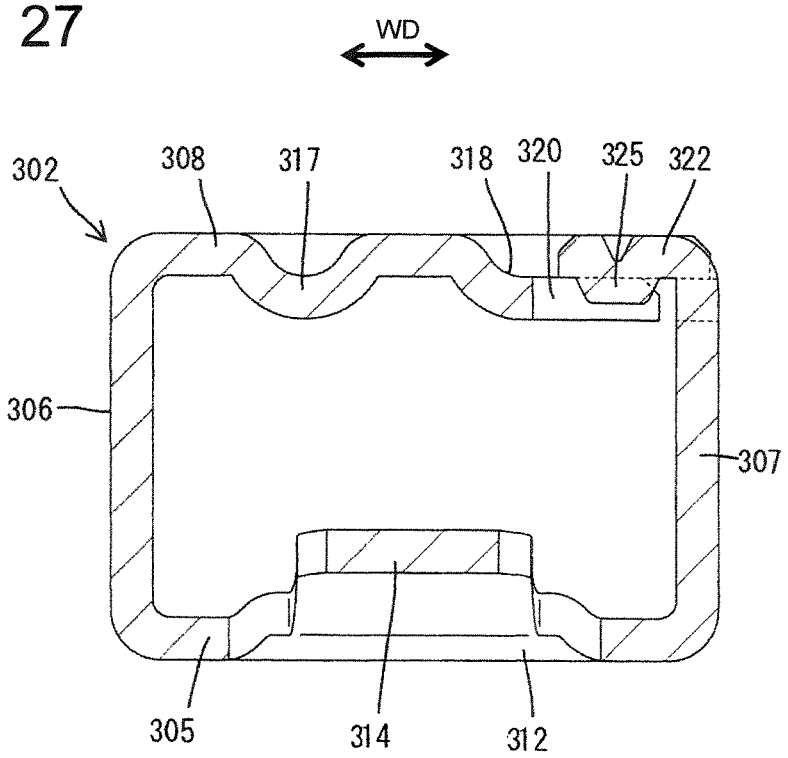
FIG. 27 is a section along C-C of FIG. 26.

FIGS. 26 and 27 show a terminal fitting T2 according to a sixth embodiment of the invention. This embodiment differs from the fifth embodiment in the configuration of the displacement preventing portion. Although the displacement preventing portion 323 is formed by cutting and bending in the fifth embodiment, it is formed to project out in this embodiment.

Also in this embodiment, a displacement preventing portion 325 is arranged at a position spaced inwardly in the width direction WD from the extending end edge of the pressing portion 322. Specifically, the displacement preventing portion 325 is formed by causing a part corresponding to the opening 320 to project out toward the opening 320 and has a substantially V-shaped cross-section. Thus, the displacement preventing portion 325 projects in a rib-like manner on the inner surface of the pressing portion 322 while having a width slightly shorter than the width of the opening 320 in forward and backward directions FBD and is inserted into the opening 320 from above. As a result, the front and rear ends of the displacement preventing portion 325 engage respective front and rear sides of the opening edge of the opening 320 to prevent relative displacements of the pressing portion 322 and the ceiling plate 308 in forward and backward directions FBD.

Other configurations are substantially same or similar to the fifth embodiment and, hence, same or similar functions and effects can be achieved.

Figure 28:
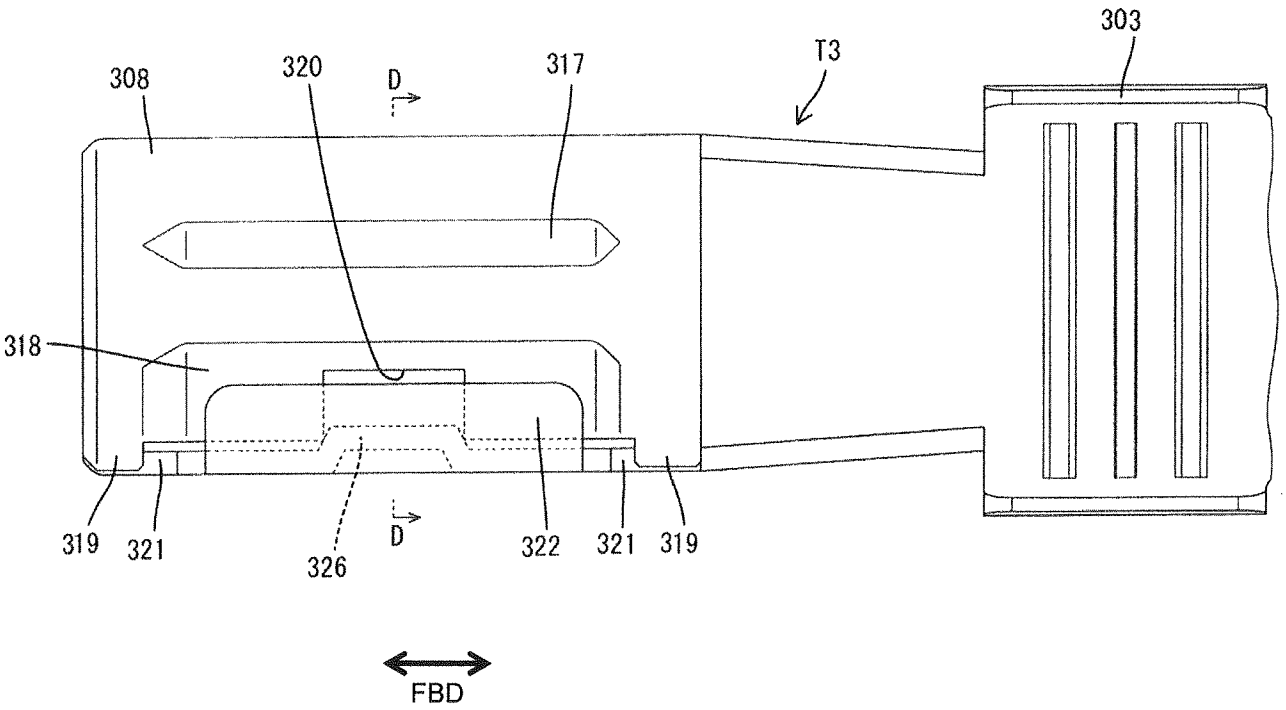
FIG. 28 is a plan view of a terminal fitting according to a third embodiment.
Figure 29:
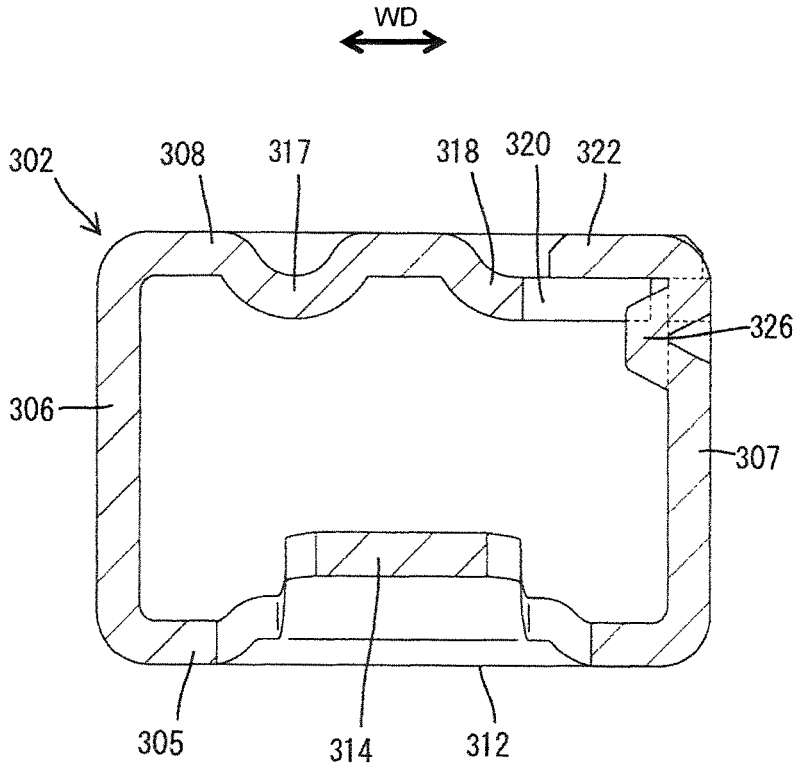
FIG. 29 is a section along D-D of FIG. 28.
Figure 30:
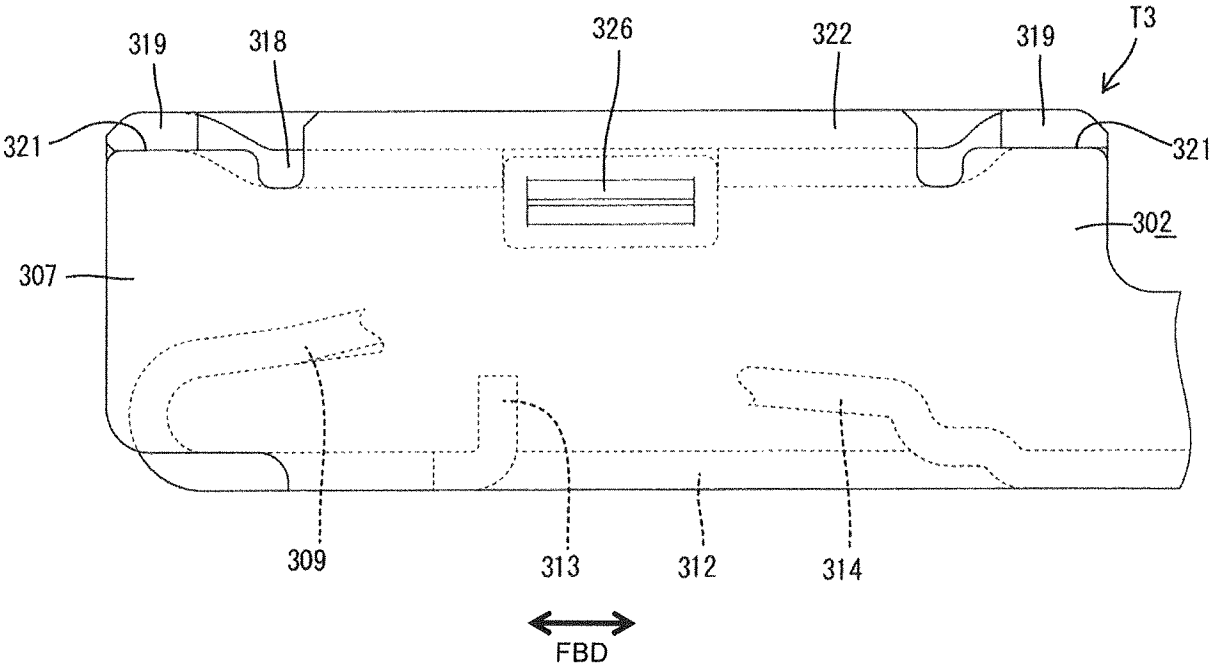
FIG. 30 is a side view of the terminal fitting.

FIGS. 28 to 30 show a terminal fitting T3 according to a seventh embodiment of the invention. This embodiment differs from the sixth embodiment in the position of a displacement preventing portion 326. Although the displacement preventing portion 325 of the sixth embodiment is formed on the pressing portion 322, the displacement preventing portion 326 of this embodiment is formed on the standing end of the second side plate 307. The displacement preventing portion 326 particularly is formed to project inwardly at a position near the rising end edge of the second side plate 307 while having a width slightly shorter than that of an opening 320 in forward and backward directions FBD. By this, the displacement preventing portion 326 particularly projects in the form of a rib substantially having a V-shaped cross-section on the inner surface of the second side plate 307 and/or particularly is laterally inserted into the opening 320. As a result, the front and/or rear ends of the displacement preventing portion 326 can be engaged with respective front and/or rear sides of the opening edge of the opening 320 to prevent relative displacements of the pressing portion 322 and the ceiling plate 308 in forward and backward directions.

The invention is not limited to the above described embodiments. For example, the following embodiments also are included in the scope of the invention.

The displacement preventing portion 323, 325, 326 is on the side of second side plate 307 and the engaging portion (opening 320) is on the side of the ceiling plate 308 in the above embodiments. However, a reverse arrangement may be adopted.

Although the opening 320 serves as the engaging portion in the above embodiments, the displacement preventing portion may be locked utilizing another configuration, e.g. a projecting structure such as the projecting pieces 319 formed by cutting and bending or a protrusion formed by striking.

What is claimed is:

1. A terminal fitting formed by bending an electrically conductive plate material, comprising:

a connecting portion including a base wall in the form of a substantially flat plate, penetrating through the base wall;

a cantilevered first spring piece arranged in the connecting portion and resiliently deformed toward the base wall;

a second spring piece being formed by bending part of the base wall defining the punched hole and projecting from the base wall toward the first spring piece and being resiliently deformed together with the first spring piece while contacting a side of the first spring piece facing the base wall; and excessive deformation preventing pieces being formed by bending parts of the base wall defining the punched hole and projecting from the base wall at substantially opposite widthwise sides of the second spring piece and being engageable with the side of the first spring piece facing the base wall for preventing excessive resilient deformation of the first spring piece.

2. The terminal fitting of claim 1, wherein the connecting portion has a tubular shape, and wherein the second spring piece is narrower than the first spring piece and projects into the connecting portion from the base wall.

3. The terminal fitting of claim 1, wherein a free end portion of the first spring piece is narrower than a base end portion that serves as a support for resilient deformation.

4. A terminal fitting, comprising:

a tubular main portion having opposite front and rear ends; and a first resilient piece cantilevered back into the main portion from a support at the front end of the main portion, the first resilient piece having a constant width from the support and a through hole penetrating the first resilient piece inward of opposite widthwise sides of the first resilient piece and forward of a rear end of the first resilient piece, the through hole being shaped to become gradually wider toward the rear end of the first resilient piece;

a second resilient piece in the main portion at a position substantially facing the first resilient piece in a resilient deforming direction of the first resilient piece, the second resilient piece being arranged to contact a substantially widthwise central portion near the rear end of the first resilient piece rearward of the through hole and being resiliently deformable as the first resilient piece is deformed; and excessive deformation preventing pieces arranged in the main portion at substantially opposite widthwise sides of the second resilient piece, the excessive deformation preventing pieces being disposed to contact substantially opposite widthwise sides of the first resilient piece near the rear end of the first resilient piece to prevent excessive deformation of the first resilient piece.

5. A terminal fitting with a tube that is insertable into a cavity of a connector housing, the connector housing having a locking lance that resiliently deforms during insertion of the tube into the cavity and that resiliently restores to engage the tube after complete insertion of the tube into the cavity, the tube comprising:

a base plate, first and second side plates projecting from the base plate and a ceiling plate extending from an end of the first side plate remote from the base plate, the ceiling plate being substantially parallel to the base plate, a rear end of the ceiling plate defining a locking edge that is engaged by the locking lance after complete insertion of the tube into the cavity;

an outer surface of the ceiling plate being struck into the tube to define a struck area joined to the ceiling plate by curved R-surfaces;

a pressing portion bent from an end of the second side plate remote from the bottom plate and placed on the outer surface of the ceiling plate in the struck area to keep the ceiling plate parallel to the base plate; and at least one bridge struck out from the curved R-surfaces to substantially fill at least one gap between an end edge of the pressing portion and a peripheral edge of the struck area and being along a slide contact path along which the locking lance slides in contact with the outer surface of the tube during insertion of the tube into the cavity, the bridge being formed to make the outer surface of the ceiling plate and an outer surface of the pressing portion substantially continuous.

6. The terminal fitting of claim 5, wherein and extending end edge of the ceiling plate is supported in contact with at least one receiving portion formed on the second side plate.

7. The terminal fitting of claim 5, wherein a depth of the struck area is substantially equal to a thickness of walls of the tube, an outer surface of the bridge being substantially flat and a height of the outer surface of the bridge being substantially equal to heights of the outer surface of the ceiling plate and the outer surface of the pressing portion.

8. The terminal fitting of claim 5, wherein the at least one bridge comprises two bridges arranged at positions to hold the pressing portion therebetween in an extending direction of the slide contact path.

9. A terminal fitting with a tube that comprises:

a base plate, a first side plate and a second side plate projecting from the base plate and a ceiling plate bent to extend from an end of the first side plate opposite the base plate and aligned substantially parallel to the base plate, an extending end part of the ceiling plate is struck inwardly of the tube to form a struck portion;

at least one pressing portion bent from an end of the second side plate opposite the base plate and be placed on an outer surface of the struck portion to be substantially flush with the ceiling plate; and an opening formed in struck portion of the ceiling plate, a displacement preventing portion formed on the second side plate and being inserted into the opening and engaging front and rear ends of the opening.

10. The terminal fitting of claim 9 wherein the displacement preventing portion is formed by bending an inner area of a substantially U-shaped cut formed at a position spaced inward from the extending end edge of the pressing portion such that the inner area having a width substantially equal to the width of the opening in forward and backward directions is inserted into the opening.

11. The terminal fitting of claim 9, wherein the displacement preventing portion is formed by causing a part spaced inwardly from the extending end edge of the pressing portion to project in a rib-like manner in a height direction so as to be inserted into the opening while having a width substantially equal to the width of the opening in forward and backward directions.

12. The terminal fitting of claim 9, wherein the displacement preventing portion is formed by causing a part of the second side plate near the end to project in a rib-like manner in the width direction within a standing height range of the second side plate from the base plate so as to be inserted into the opening while having a width substantially equal to the width of the opening in forward and backward directions.

13. The terminal fitting of claim 9, wherein:

the terminal fitting is processed in a developed state and a plurality of terminal fittings are coupled to a carrier in a chain-like manner in the developed state; and the extending end edge of the pressing portion and that of the ceiling plate face each other in a linkage direction between the terminal fittings adjacent to each other in the linkage direction in the coupled state.

* * * * *